US011000775B1

(12) United States Patent
Riegelman

(10) Patent No.: US 11,000,775 B1
(45) Date of Patent: May 11, 2021

(54) ITEM FOR CHILD'S PLAY AND EDUCATION CHANGEABLE BETWEEN A BOOK AND TOY

(71) Applicant: Bendon, Inc., Ashland, OH (US)

(72) Inventor: Rianna Lynn Riegelman, Lafayette, CO (US)

(73) Assignee: BENDON, INC., Ashland, OH (US)

( * ) Notice: Subject to any disclaimer, the term of this patent is extended or adjusted under 35 U.S.C. 154(b) by 0 days.

(21) Appl. No.: 16/735,912

(22) Filed: Jan. 7, 2020

Related U.S. Application Data

(60) Provisional application No. 62/791,387, filed on Jan. 11, 2019.

(51) Int. Cl.
*A63H 33/38* (2006.01)
*B42D 3/12* (2006.01)

(52) U.S. Cl.
CPC ..... *A63H 33/38* (2013.01)

(58) Field of Classification Search
CPC ..... B42D 3/00; B42D 3/12; A63H 33/00; A63H 33/38; A63H 3/02
USPC ..... 446/71–73, 75; 281/29, 31, 51
See application file for complete search history.

(56) References Cited

U.S. PATENT DOCUMENTS 4,853,994 A * 8/1989 Ekstein ..... A47G 9/1045 5/639
5,472,364 A * 12/1995 Castleman ..... A63H 33/004 281/29
5,676,482 A * 10/1997 Hawkins ..... B42D 1/08 281/31

* cited by examiner

*Primary Examiner* — Kien T Nguyen
(74) *Attorney, Agent, or Firm* — Ralph E. Jocke; Colin P. Cochran; Walker & Jocke

(57) ABSTRACT

An item for child's play and education changeable between book and toy configurations. In the book configuration, the item includes a first cover of flexible material that has a first side that is externally exposed and a second side that bounds a cover pocket extending within the first cover. The item further includes a plurality of pages and a second cover that are operatively connected to the first cover by a spine. The item may be changed from the book to the toy by turning the cover pocket inside out to form a toy pocket such that the second side of the flexible material is externally exposed and the first side bounds the toy pocket. In the toy configuration, the plurality of pages, second cover, and the spine are housed within the toy pocket. An exemplary item may be further changeable between additional book and toy configurations.

29 Claims, 18 Drawing Sheets

ITEM FOR CHILD'S PLAY AND EDUCATION CHANGEABLE BETWEEN A BOOK AND TOY

TECHNICAL FIELD

Exemplary embodiments relate to items for child's play. Exemplary embodiments include an item for child's play that is transformable between a book and a toy.

BACKGROUND

Items for child's play are designed to stimulate the child. Items for child's play may be educational in nature. Items for child's play are designed to grab and maintain the child's attention.

Items for child's play may benefit from improvements.

SUMMARY OF THE DISCLOSURE

Exemplary embodiments relate to an item for child's play. The exemplary embodiment is configured to be transformed between a book and a toy. An exemplary embodiment has a first cover, a second cover, and a plurality of pages. In a book configuration, the plurality of pages are in sandwiched relation between the first cover and the second cover. The first cover, the second cover, and the plurality of pages are operatively connected by a spine.

In an exemplary embodiment the first cover includes a cover pocket extending within the first cover. The item is changeable from the book configuration to a toy configuration by the cover pocket being manually turned inside out to form a toy pocket. In the toy configuration, the second cover and the plurality of pages are housed within an interior area of the toy pocket.

Alternative exemplary embodiments include a child's toy that is manually changeable between multiple book configurations and toy configurations.

Further features of exemplary embodiments will be made apparent from the following detailed description.

DETAILED DESCRIPTION

Figure 1:
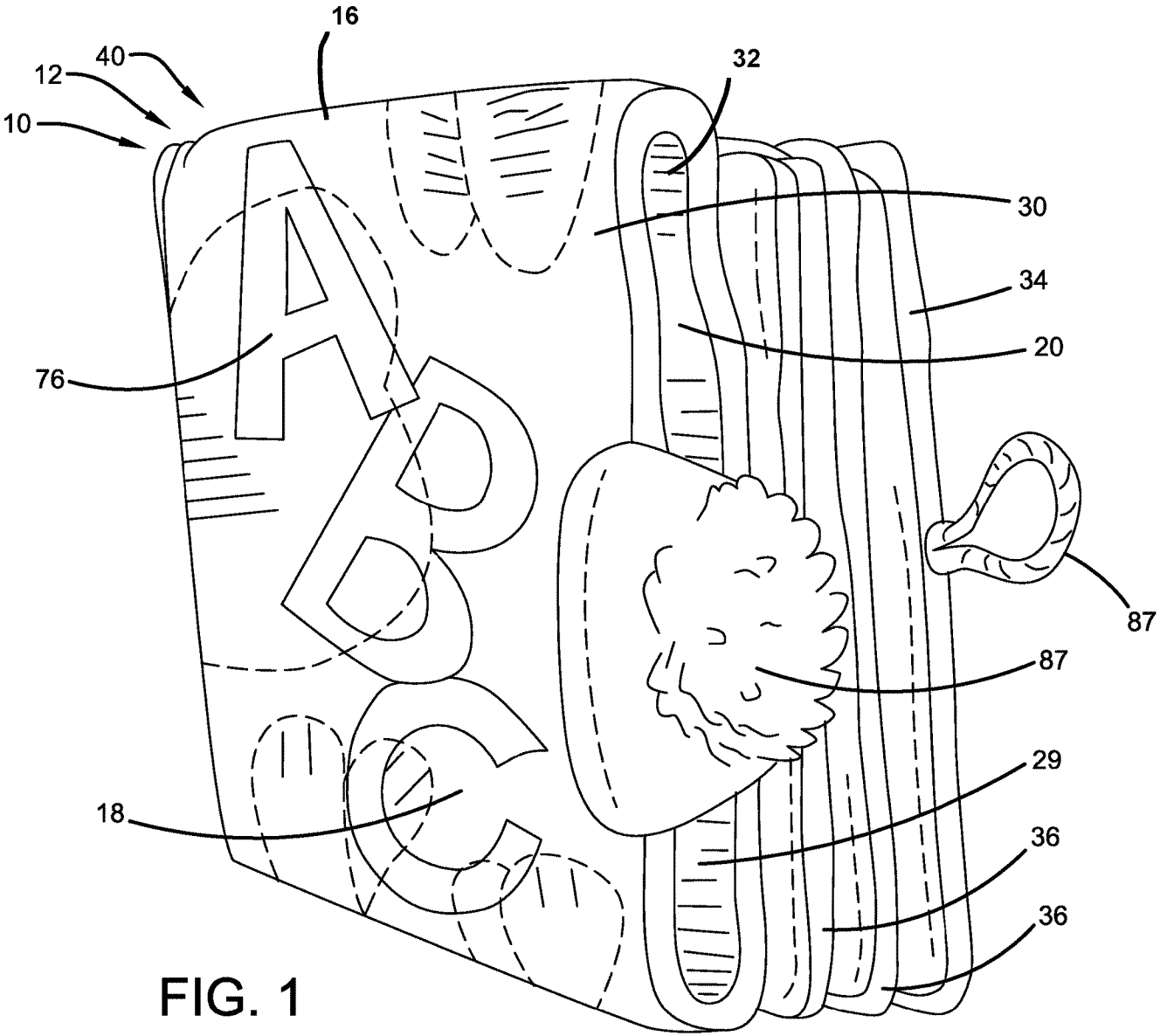
FIG. 1 is a front right side perspective view of an exemplary item in a book configuration and in a closed book position.

Referring now to the drawings and particularly to FIG. 1, there is shown an exemplary item 10 for child's play that is manually changeable between a book configuration and a toy configuration. The exemplary item 10 in FIG. 1 is shown in a book configuration 12 and in a closed book position 40. The item 10 includes a first cover 16 and a second cover 34. The item 10 further includes a plurality of pages 36 which, in the closed book position, are in sandwiched relation between the first cover 16 and second cover 34. Of course, it should be understood that this arrangement is exemplary, and in other embodiments, alternative arrangements may be utilized.

As shown in FIG. 1, the exemplary first cover 16 is comprised of flexible material 18. However, exemplary first cover 16 may comprise various suitable materials. For example, first cover 16 may comprise soft, plush, pliable material, elastic material, cloth, waterproof material, or any combination thereof. The exemplary first cover comprises a first side 30 of material 18 and a second side 32 of material 18. The exemplary first side 30 of the flexible material is in overlying relation of the second side 32 of the material in the book configuration. The exemplary first cover 16 further includes a cover pocket 20 extending within the first cover 16. When the item 10 is in the exemplary book configuration the first side 30 of the material is externally exposed on the item, and the second side 32 of the material bounds a cover interior area 29 of the cover pocket 20. The exposed first side 30 of the material is in overlying relation to the second side 32 of the material bounding the cover pocket 20. However, it should be noted that the first cover material and this first cover configuration are exemplary, and in other embodiments, other first cover materials and configurations may be used.

Referring still to FIG. 1, in the exemplary book configuration of the item, the exemplary first side 30 of the flexible material 18 includes exposed viewable first cover indicia 76. Exposed viewable first cover indicia 76 may comprise text, writing, numbers, pictures, or graphics for example. Further, exemplary exposed viewable first cover indicia 76 may correspond to a common character, theme, or story that is associated with the item 10.

Figure 2:
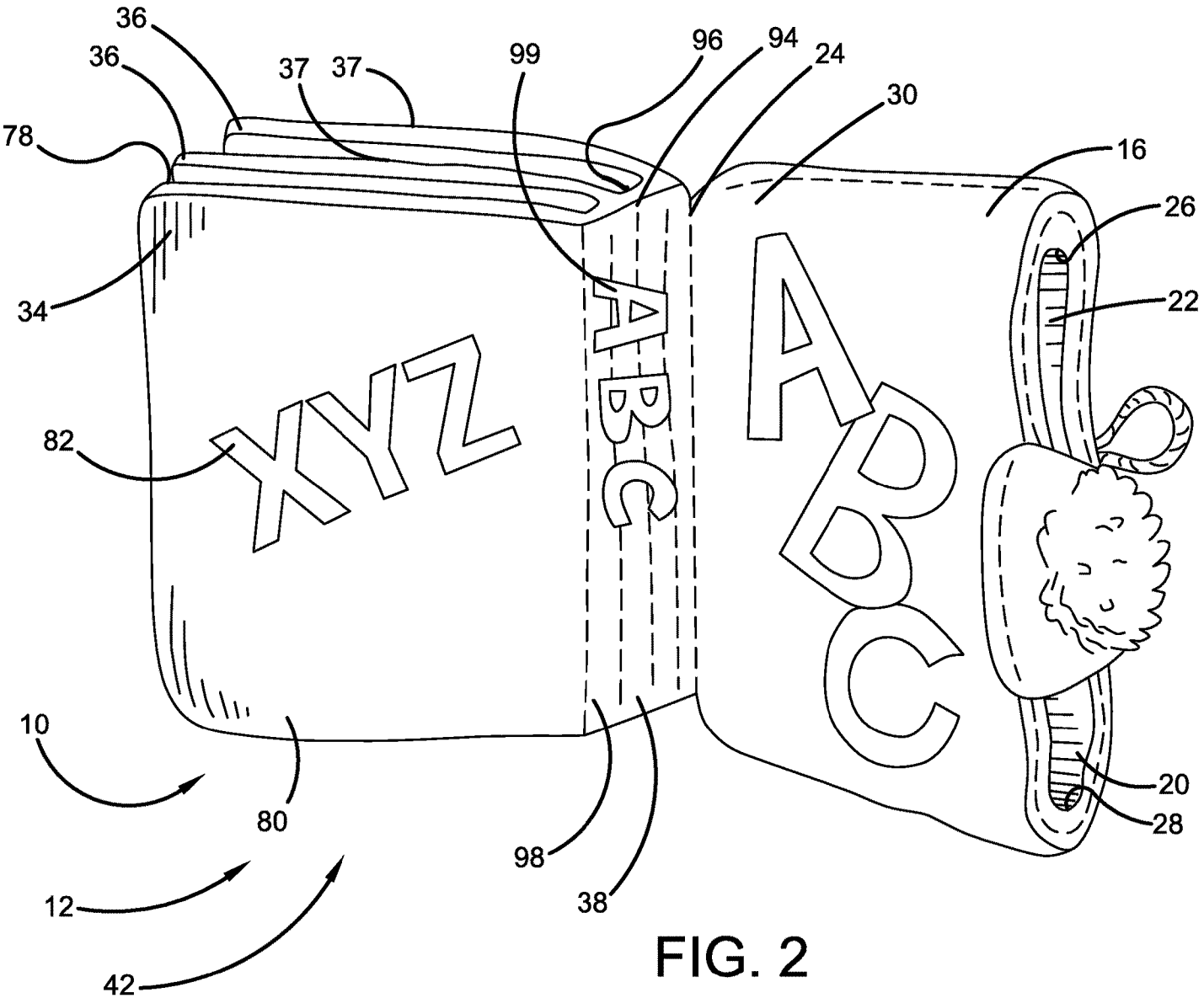
FIG. 2 is a back side view of the exemplary item of FIG. 1 in a book configuration and in an open book position.

Referring now to FIG. 2, exemplary item 10 is shown in the book configuration and in an open book position 42. The exemplary item 10 includes a spine 38 that connects in operatively attached movable engagement, the second cover 34, the plurality of pages 36, and the first side 30 of the flexible material of the first cover 16. Of course, it should be noted that these configurations are exemplary, and in other embodiments, other configurations may be used.

In the exemplary book configuration 12, as shown in FIG. 2, second cover 34 includes a second cover inside face 78, and an opposed second cover outside face 80. The exemplary second cover inside face 78 is engageable with the immediately adjacent page of the plurality of pages 36. The exemplary second cover outside face 80, as shown in FIG. 2, is externally exposed when the item 10 is in the book configuration. The second cover outside face 80 includes exposed viewable second cover indicia 82. In exemplary embodiments, the exposed viewable second cover indicia 82 may comprise text, writing, numbers, pictures, or graphics, for example. Further, exemplary exposed viewable second cover indicia 82 may correspond to a common character, theme, or story of the item 10. It should be understood that this second cover configuration is exemplary, and in other embodiments, other second cover configurations may be used.

In FIG. 2, the exemplary cover pocket 20 of the first cover 16 is shown in more detail. Exemplary cover pocket 20 comprises a cover pocket open end 22 at an end of the cover pocket disposed away from spine 38. Exemplary cover pocket 20 further comprises a cover pocket closed end generally indicated 24 within the cover pocket, adjacent the spine 38, and in underlying relation to the first side 30 of the flexible material 18. The exemplary spine 38 is attached to the first side 30 of the flexible material of the first cover 16 in overlying relation of the cover pocket closed end 24. The exemplary cover pocket 20 further includes a pair of cover pocket closed side edges 26 and 28 that extend between the open end 22 and the closed end 24. The exemplary pair of closed side edges 26 and 28 form closed bounding edges that extend the distance between the cover pocket open end 22 and the cover pocket closed end 24. However, it should be understood that this cover pocket configuration is exemplary, and in other embodiments, other cover pocket configurations may be used.

In the exemplary open book position 42 of item 10, in the exemplary book configuration, as shown in FIG. 2, the exemplary first cover 16 and the second cover 34 are disposed away from one another such that each of the plurality of pages 36 are individually manually turnable. Each of the exemplary plurality of pages 36 include a pair of opposed planar page faces 37. When the exemplary item 10 is in the book configuration and the open book position, each of the plurality of pages are manually engageable and turnably positionable such that each of the opposed page faces 36 of each respective page are separately viewable. It should be noted that this page configuration is exemplary, and in other embodiments, other page configurations may be used. The exemplary shape, material, and structure of the plurality of pages 36 of some exemplary embodiments will be described later in more detail.

Figure 11:
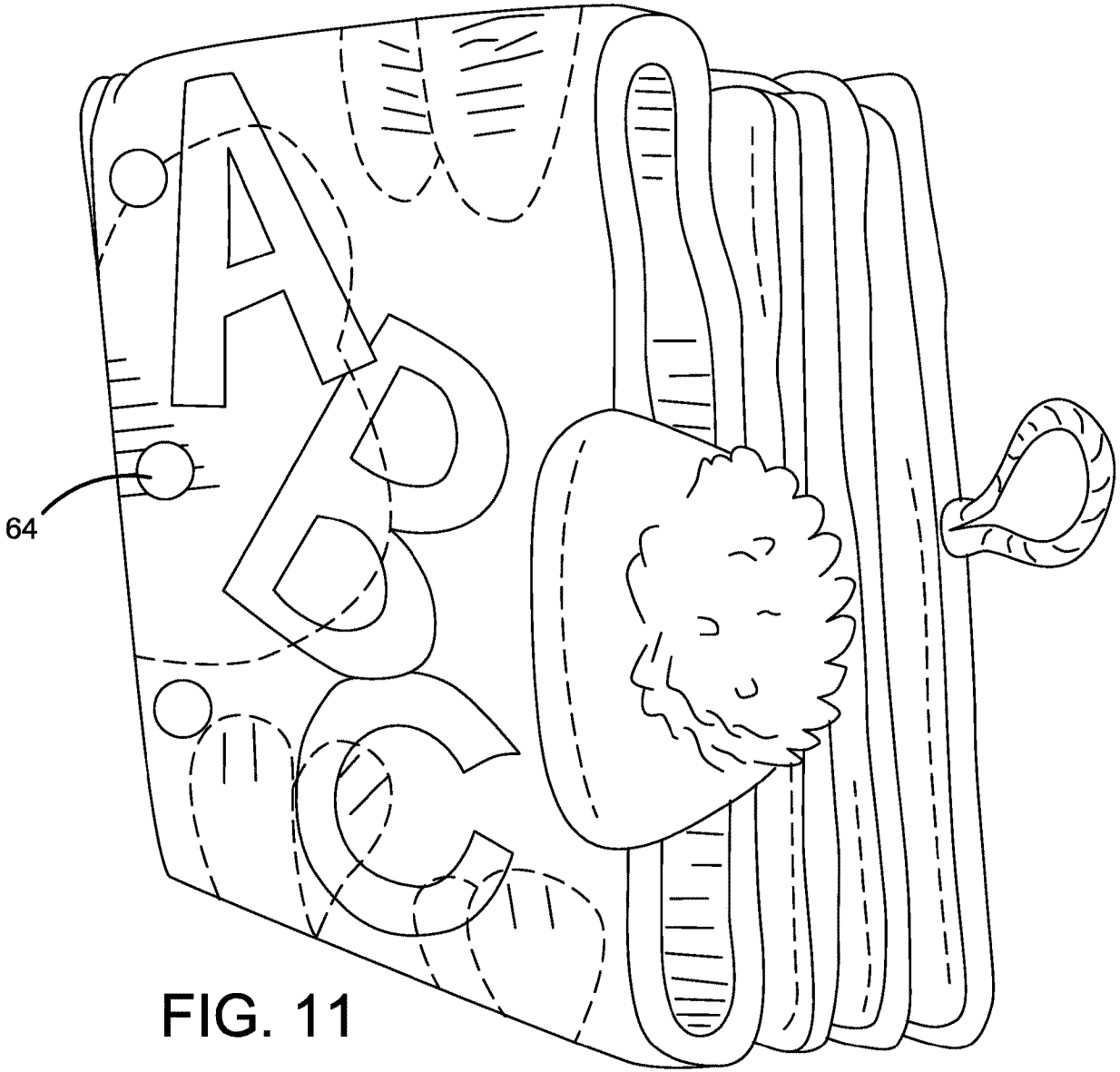
FIG. 11 is a front right side perspective view of a further exemplary item in a book configuration and in a closed book position with an exemplary spine including fasteners.

The exemplary spine 38 may comprise various types of suitable materials. For example, spine 38 may be comprised of flexible material such as soft, plush, pliable material, cloth, pliable plastic, elastic material, waterproof material, or any combination thereof. In other embodiments, such as shown in FIG. 11, spine 38 may comprise at least one fastener 64. The exemplary at least one fastener 64 extends between and through the first and second sides of the flexible material of the first cover 16, the plurality of pages 36, and the second cover 34. Each fastener 64 connects the first cover 16, the plurality of pages 36, and the second cover 34 in operatively attached movable engagement. Of course, it should be understood that these spine configurations and materials are exemplary, and in alternative embodiments, other spine configurations, materials and attachment structures may be used.

Referring again to FIG. 2, the exemplary spine 38 includes a first side 96 and an opposed second side 98. Each of the plurality of pages 36 is in attached connection with the first side 96. With the item in the book configuration, the exemplary second side 98 includes exposed viewable spine indicia 99. In exemplary embodiments, exposed viewable spine indicia 99 may comprise text, writing, numbers, pictures, or graphics, for example. Further, exemplary exposed viewable spine indicia 99 may correspond to a common character, theme, or story of the item 10.

Figure 3:
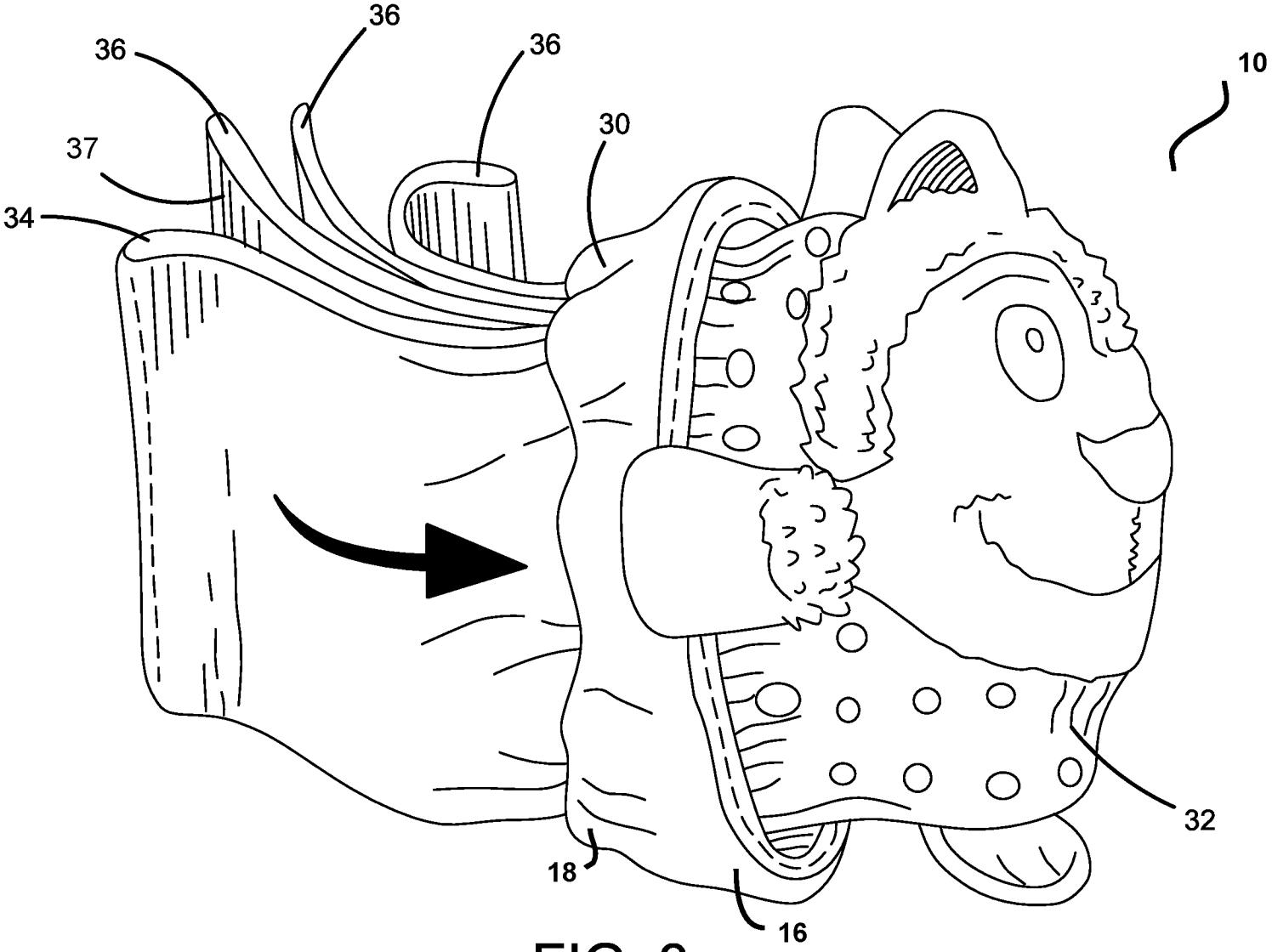
FIG. 3 is a back side view of an exemplary item of FIG. 1 in an open book position being changed to an exemplary toy configuration.

Referring now to FIG. 3, the exemplary item 10 is changeable from the book configuration 12 to a toy configuration 14 by the cover pocket being manually turned inside out. FIG. 3 shows exemplary item 10 halfway through the change from the book configuration to the toy configuration. The exemplary item 10 is changeable from the book configuration to the toy configuration by manually rolling back the first side 30 of the flexible material 18 of the first cover 16 in a telescoping manner. When the first side 30 is completely rolled back on itself the flexible material 18 surrounds the length of the plurality of pages between each page first end 56 and second end 58, which will be described later in greater detail.

Figure 4:
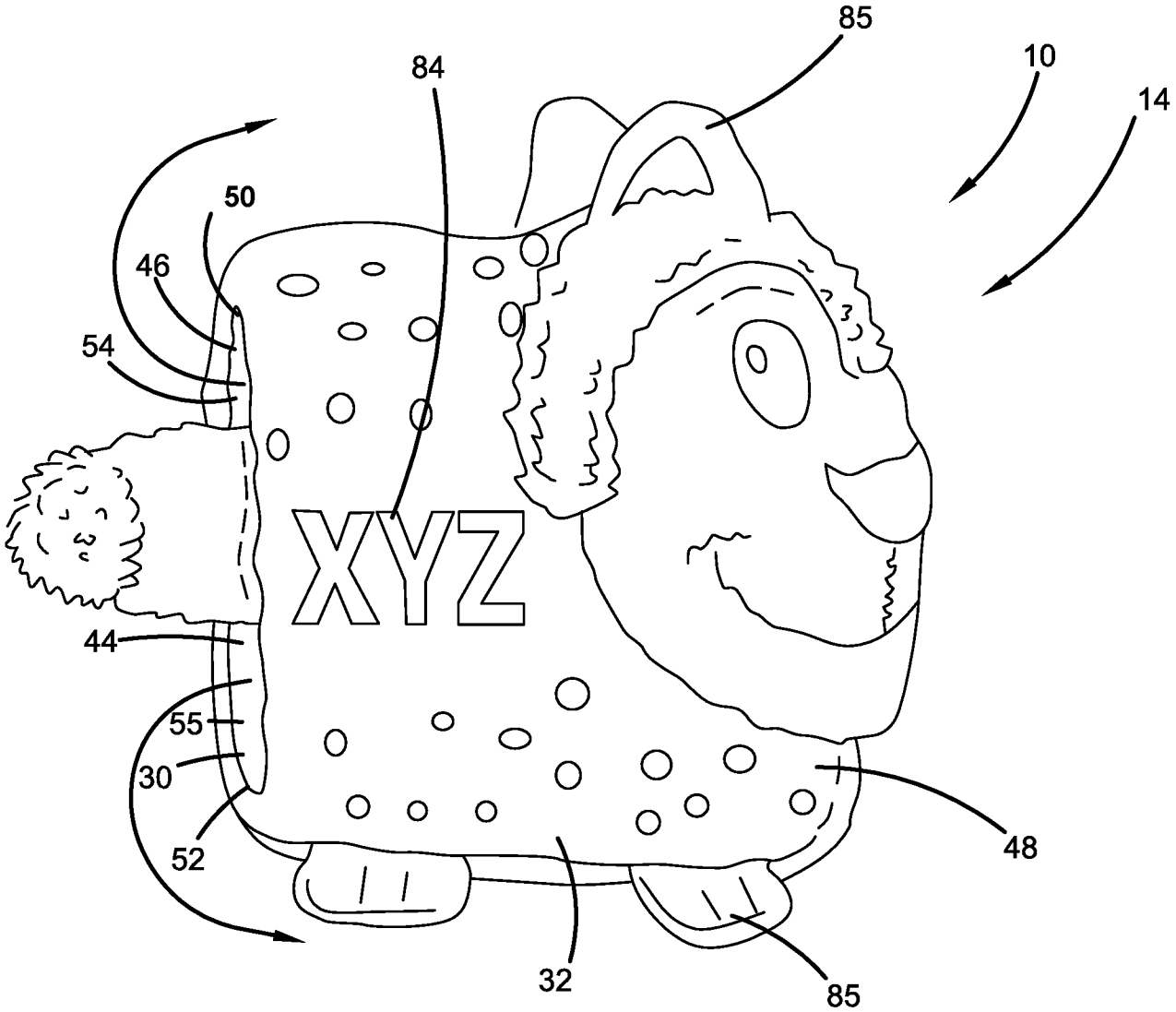
FIG. 4 is a back side view of the exemplary item of FIG. 1 in a toy configuration.

As the exemplary first side 30 of the flexible material 18 is rolled back on itself and over the length of the plurality of pages 36, the second side 32 of the flexible material is gradually externally exposed on the item 10. The exemplary first side 30 of the flexible material 18, as it is rolled back on itself, begins to form a toy pocket 44 as shown in FIG. 4. Once completely rolled back, the first side of the flexible material 18 bounds the toy pocket 44. When the first side of the flexible material 30 is completely rolled inside out so as to surround the length of the plurality of pages between the first end and the second end, and the second side of the material is completely externally exposed on the item 10 as shown in FIG. 4, the item 10 has been changed into the exemplary toy configuration 14.

FIG. 4 shows the item 10 in the exemplary toy configuration 14. In the exemplary toy configuration, the second side 32 of the material 18 is externally exposed on the item 10 and the first side of the material 30 bounds the toy interior area 54 of the toy pocket 44. In the exemplary toy configuration, the second side 32 of the material is in overlying relation of the first side 30 of the material. In the exemplary toy configuration, each of the plurality of pages 36 and the spine are housed within the toy interior area 54 of the toy pocket 44 in underlying relation of the second side of the material. Of course, it should be noted that this configuration and function is exemplary, and in other embodiments, other configurations may be used.

Still referring to FIG. 4, the exemplary toy pocket 44 comprises a toy pocket open end 46, a toy pocket closed end 48, and a pair of toy pocket side edges 50 and 52 that extend between the toy pocket open end 46 and toy pocket closed end 48. The exemplary toy pocket closed end 48 is in underlying relation to the first side 30 of the flexible material 18. The exemplary pair of toy pocket side edges 50 and 52 form bounding edges that traverse the distance between the toy pocket open end 46 and the toy pocket closed end 48. In the exemplary toy configuration 14 the spine 38 is housed within the toy pocket 44 and is adjacent the toy pocket closed end 48. Further, the exemplary second end 58 of each respective page, which is disposed furthest away from the spine as described later in more detail, is immediately adjacent the pocket opening 55. However, it should be noted that this toy pocket configuration is exemplary, and in other embodiments, other toy pocket configurations may be used.

As shown in FIG. 4, when the item is in the exemplary toy configuration 14, the second side 32 of the flexible material 18 of the first cover 16 includes exposed viewable toy indicia 84. In exemplary embodiments, exposed viewable toy indicia 84 may comprise text, writing, numbers, pictures, or graphics for example. Further, exemplary exposed viewable toy indicia 84 may correspond to a common character, theme, or story of the item 10. Additionally, the exemplary exposed second side 32 of the flexible material of the first cover 16 when in the toy configuration includes outward extending projections 85. The exemplary outward extending projections 85 may represent an aspect or feature of a common character, theme, or story of the item 10 when in the toy configuration 14. The exemplary outward extending projections 85 may include but are not limited to, at least one of an animal appearance feature, a human appearance feature, an automobile appearance feature, a train appearance feature, a plane appearance feature, or a sports ball appearance feature.

Figure 5:
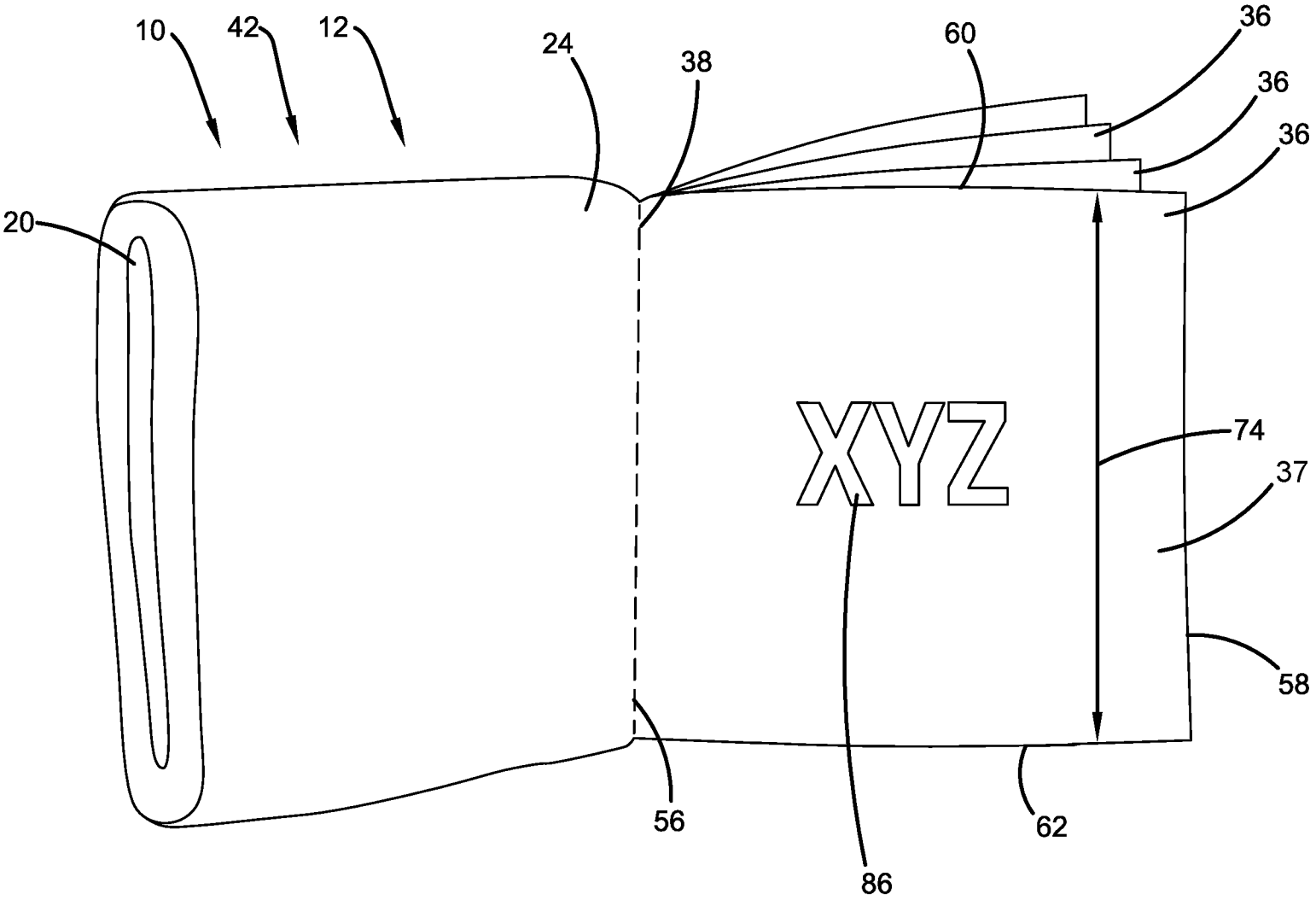
FIG. 5 is a front side perspective view of an exemplary item of FIG. 1 in the book configuration and an open book position.

Referring now to FIG. 5 showing the item 10 in the exemplary book configuration, each of the plurality of pages 36 has a first end 56, a second end 58, and a pair of disposed page edges 60 and 62. In the exemplary book configuration 12, the first end 56 of each respective page of the plurality of pages 36 is operatively attached to the spine 38 and is immediately adjacent the closed end 24 of the cover pocket 20. The exemplary second end 58 of each respective page of the plurality of pages 36 is disposed away from the spine 38 and is free to move such that each page is movably turnable and separately viewable. An exemplary page of the plurality of pages 36 further includes a second end page dimension 74. The exemplary second end page dimension 74 is the dimension which page edge 60 and page edge 62 of a respective one of the plurality of pages is disposed transversely away from one another at the second end 58 of each page. Second end page dimension 74 of a respective one of the plurality of pages 36 is generally equal to the second end page dimension of each of the other plurality of pages. Each of the plurality of pages 36 may comprise various types of suitable material. For example, each of the plurality of pages 36 may comprise soft, plush, pliable material, foam, foam encased in cloth, foam encased in relatively flexible plastic or film, crinkle paper, material that is more rigid than the flexible material 18 of the first cover, waterproof material, or any combination thereof. The plurality of pages 36 may include thereon viewable page indicia 86. Exemplary viewable page indicia 86 may comprise text, writing, numbers, pictures, or graphics for example. Further, exemplary viewable page indicia 86 may correspond to a common character, theme, or story associated with the item 10. Of course, it should be understood that these page configurations and materials are exemplary, and in other embodiments, other page configurations and materials may be used.

When the exemplary item 10 is in the exemplary toy configuration 14, the first end 56 of each respective page of the plurality of pages 36 and the spine 38 are housed within the toy pocket 44 such that the second end 58 of each respective page of the plurality of pages 36 is immediately adjacent the toy pocket open end 48 and the toy pocket opening 55. In the exemplary toy configuration 14, a respective one of the pair of disposed page edges 60 and 62 of each page is positioned immediately adjacent a respective one of the pair of closed side edges 50 and 52 of the toy pocket 44. In the exemplary toy configuration 14, each of the plurality of pages 36, the spine 38, and the second cover 34 are completely housed within the toy interior area 54 of the toy pocket 55 such that no portion of each of the plurality of pages 36, the spine 38, or the second cover 34 extend outside of the toy interior area 54 or beyond the toy pocket opening 55. However, this toy pocket configuration is exemplary, and in other embodiments, other toy configurations may be used.

Figure 6A:
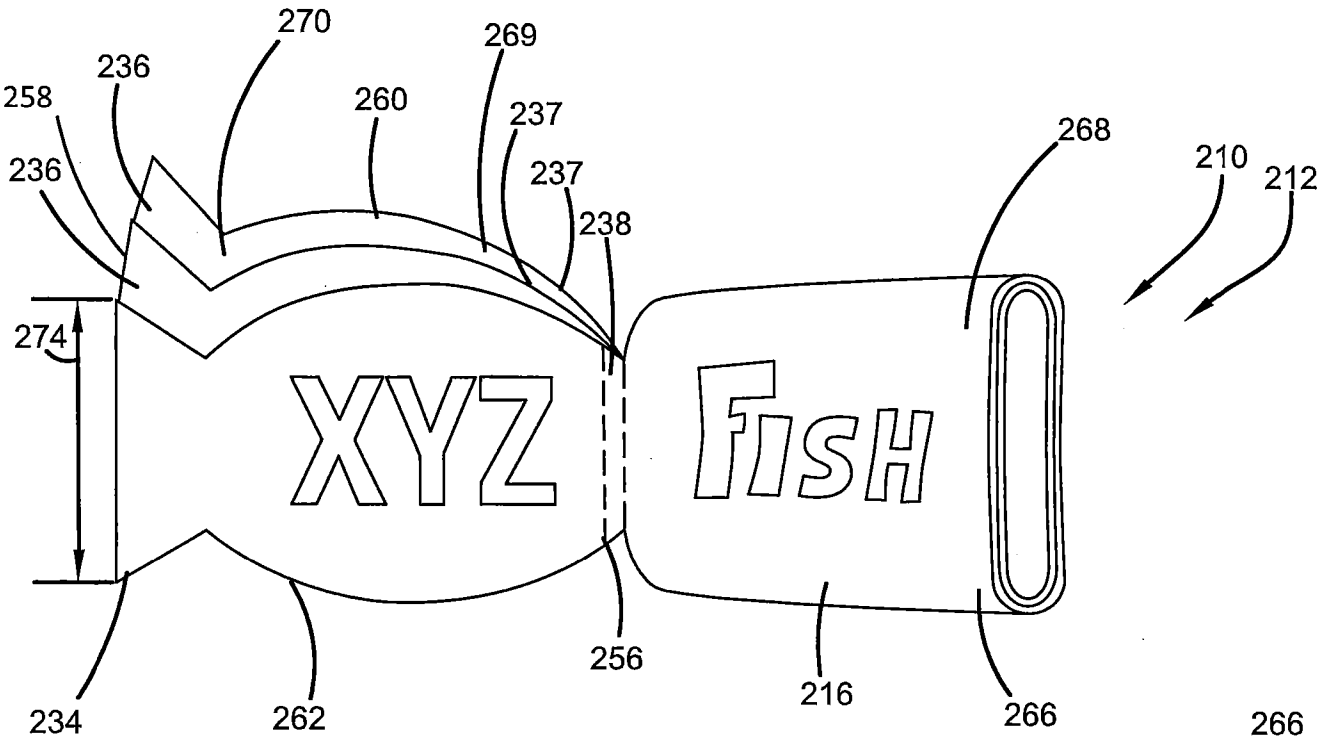
FIG. 6A is a back side perspective view of an alternative exemplary item in a book configuration and an open book position.
Figure 6B:
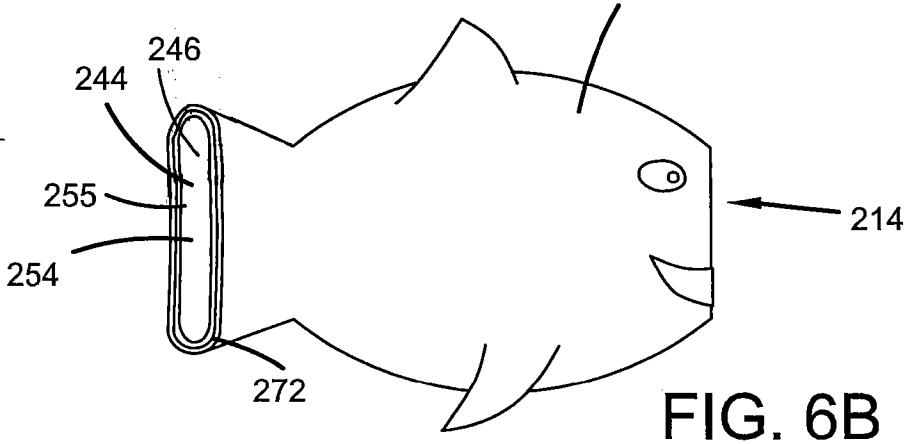
FIG. 6B is a back side view of the item of FIG. 6A in a toy configuration.

An alternative exemplary embodiment of an item 210 is shown in FIGS. 6A and 6B. The alternative exemplary embodiment item 210 is similar to item 10 except as discussed. The exemplary item 210 is manually changeable between a book configuration and a toy configuration. Item 210 in a book configuration has an exposed first cover 216 comprised of elastic material 266. In this exemplary alternative embodiment, when the item 210 is in the exemplary book configuration 212 and an open book position 242, the elastic material 266 of the first cover 216 has an undeformed book cover shape 268. Further in this exemplary alternative embodiment, when the item 210 is undergoing change from the book configuration 212 shown in FIG. 6A to the toy configuration 214 shown in FIG. 6B, the exemplary elastic material 266 of the first cover 216 is stretched when manually turned inside out to form the toy pocket 244. When this alternative exemplary embodiment is manually turned from the toy configuration 214 back to the book configuration 212, the flexible material of the first cover comprised of the elastic material 266 returns to the original undeformed book cover shape 268.

Referring again to FIGS. 6A and 6B, in this exemplary alternative embodiment, each of the plurality of pages 236 and the second cover 234 is comprised of a page material 269. In this exemplary embodiment, exemplary page material 269 is more rigid than the elastic material 266 of the first cover 216. Further, in this exemplary alternative embodiment each of the opposed faces 237 of each of the exemplary plurality of pages 236 comprise planar faces that extend in generally parallel relation. Each of the page edges 260 and 262 and the first end 256 (attached to the spine 238) and second end 258 (away from the spine 238), of each respective page define a page shape 270. The second cover 234 may also have the same shape. Generally, each of the pages of the plurality of pages 236 extending in the generally parallel direction are of the page shape 270. In this exemplary alternative embodiment, when the elastic material 266 of the first cover is manually turned inside out such that the item is in the toy configuration 214, the elastic material 266 conforms to the page shape 270 of the plurality of pages 236 and the second cover. Thus, in this alternative exemplary embodiment, when the exemplary item 210 is in the toy configuration 214, the item 210 is in the shape of the plurality of pages 236. The exemplary page shape 270 may be a shape corresponding to a common character, theme, object, or story of the item 10. For example, FIG. 6B depicts the item 210 in the shape of a fish when in the toy configuration. However, these shapes and configurations of the pages and the first cover are exemplary, and in other embodiments, other shapes and configurations of the pages and the first cover may be used.

Further in this exemplary alternative embodiment, in the exemplary toy configuration 214, the exemplary toy pocket opening 255 is adjacent the toy pocket open end 246 and is in spatial communication with the toy pocket interior area 254 of the toy pocket 244. When the elastic material 266 of the first cover 216 is manually turned inside out so as to surround the length of the plurality of pages 236 and the second end 258 of each respective page, the exemplary toy pocket open end 246 constricts itself around the second end 258 of the plurality of pages 236 and the second cover such that the toy pocket opening 255 is smaller than the second end page dimension 274 of each of the plurality of pages. In other exemplary embodiments, the toy pocket opening 255 includes an elastic ring 272 in surrounding relation to the toy pocket opening. The exemplary elastic ring 272 may resiliently contract to be smaller than the second end page dimension 274 of each of the plurality of pages 236. Thus, the elastic ring 272 functions in the same manner as the toy open end 246 comprised of elastic material 266 such that the elastic ring 272 causes the toy pocket opening 255 to be smaller than the second end page dimension 274 of each of the plurality of pages 236. However, it should be understood that these alternative embodiments are exemplary, and in other alternative exemplary embodiments, different arrangements, functions, and configurations may be realized without departing from the scope of the teachings presented herein.

Figure 7:
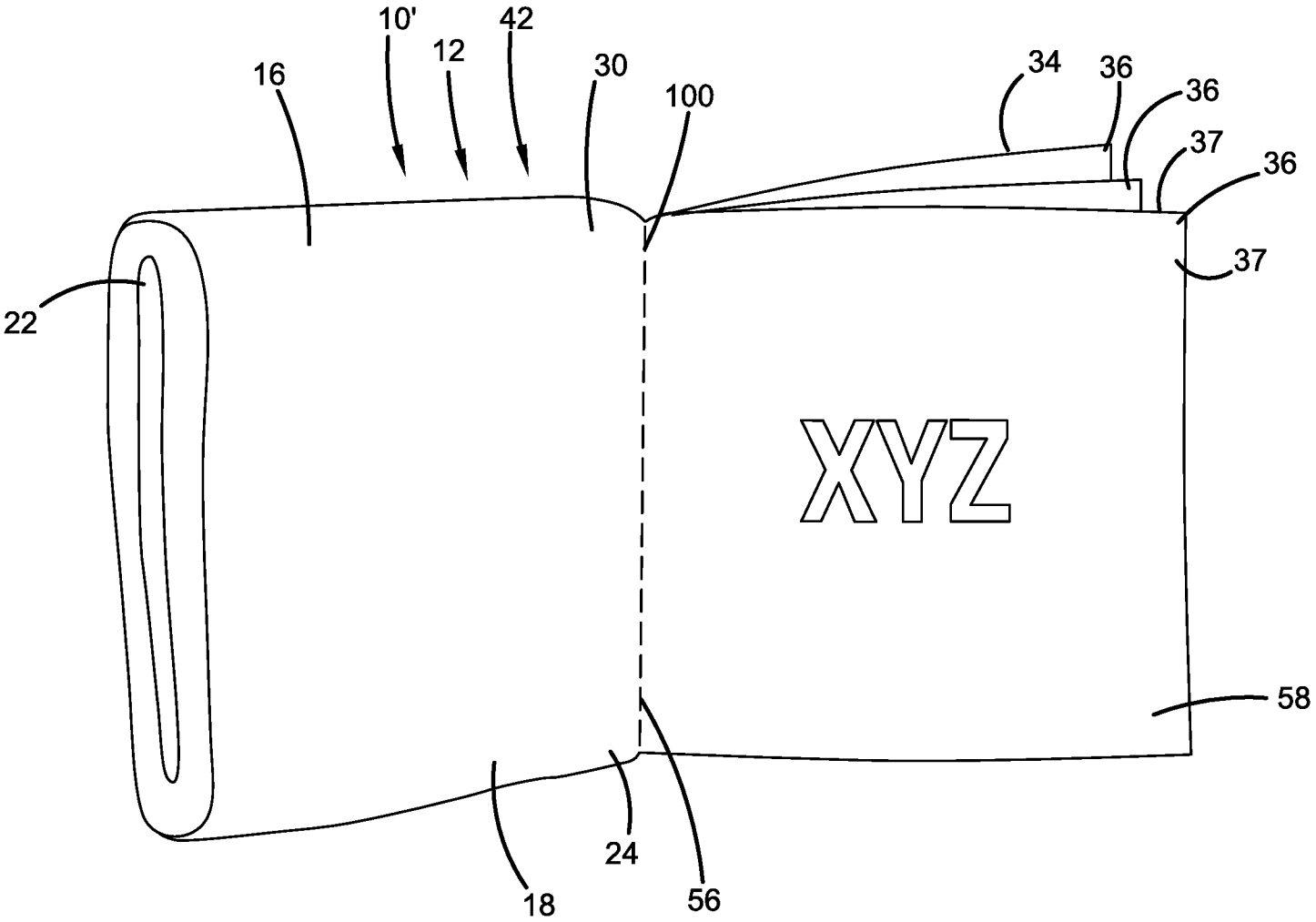
FIG. 7 is a front side perspective view a further alternative exemplary item in an exemplary book configuration and in an open book position.

Referring now to FIG. 7, an alternative exemplary embodiment of an item 10' is similar to item 10 except as specifically indicated. The exemplary item 10' includes a first cover 16 and a plurality of pages 36. Each of the exemplary plurality of pages 36 includes an attachment edge 100. Each of the plurality of pages are operatively connected to the other pages at the respective first end 56 along the attachment edge 100 of each respective page. Each of the plurality of pages 36 is connected in operatively attached movable engagement with the first side 30 of the flexible material 18 of the first cover 16 at the attachment edge 100 of each respective page. The exemplary attachment edge 100 of each respective page is in operative attached connection with the first side 30 of the flexible material 18 in overlying relation of the cover pocket closed end 24. In the alternative exemplary item 10', each page 36 is attached to the item at the attachment edge 100 by sewing, adhesive or other attaching means so as to provide a spine connecting the plurality of pages in a manner similar to spine 38 of item 10. In this alternative exemplary embodiment, in the book configuration 12, and in an open book position 42, each of the plurality of pages 36 are manually movable to be sufficiently disposed away from one another at the second end 58 of each respective page such that each of the opposed faces 37 of each of the plurality of pages 36 are manually positionable to be separately viewable. Further in some alternative exemplary arrangements the item may not have a second cover 34 that differs in size or shape from the plurality of pages 36. Of course, it should be understood that this configuration is exemplary, and in other embodiments other configurations may be used.

Referring again to FIG. 1, the exemplary embodiment of item 10 includes a releasable clasp 87. The exemplary releasable clasp 87 allows the item 10, when in the book configuration 12, to be securely fixed in a closed book position 40. The exemplary releasable clasp 87 is operatively attached to the first cover 16 and the second cover 34. As shown in FIGS. 9A, 9B, 10A, and 10B, the exemplary releasable clasp 87 includes a first piece and a second piece. Such pieces may be comprised of a pair of hook 93 and loop 94 structures, a pair of tieable laces 88, a releasably engageable first snap piece 89 and a second snap piece 90, or a piece including a button 91 and a piece includes a hole 92, for example. The exemplary first and second pieces are releasably engageable with one another. The exemplary first piece is in operative fixed attachment with the first cover adjacent the open end of the first cover. The exemplary second piece is in operative fixed attachment with the second cover adjacent the second end of each of the plurality of pages 36.

In other exemplary embodiments, a third releasable clasp piece, similar to the second piece, may be in fixed operative connection with the second side of the flexible material 18 opposite the first releasable clasp piece attached to the first cover 34. Thus, when the item is in the toy configuration 14 the plurality of pages 36 and the spine 38 may be securely fixed inside the toy pocket 44 when the first releasable clasp piece and the third releasable clasp piece are engaged. However, it should be understood that these embodiments of the releasable clasp piece are exemplary, and in other embodiments, other releasable clasp configurations may be used.

Figure 8:
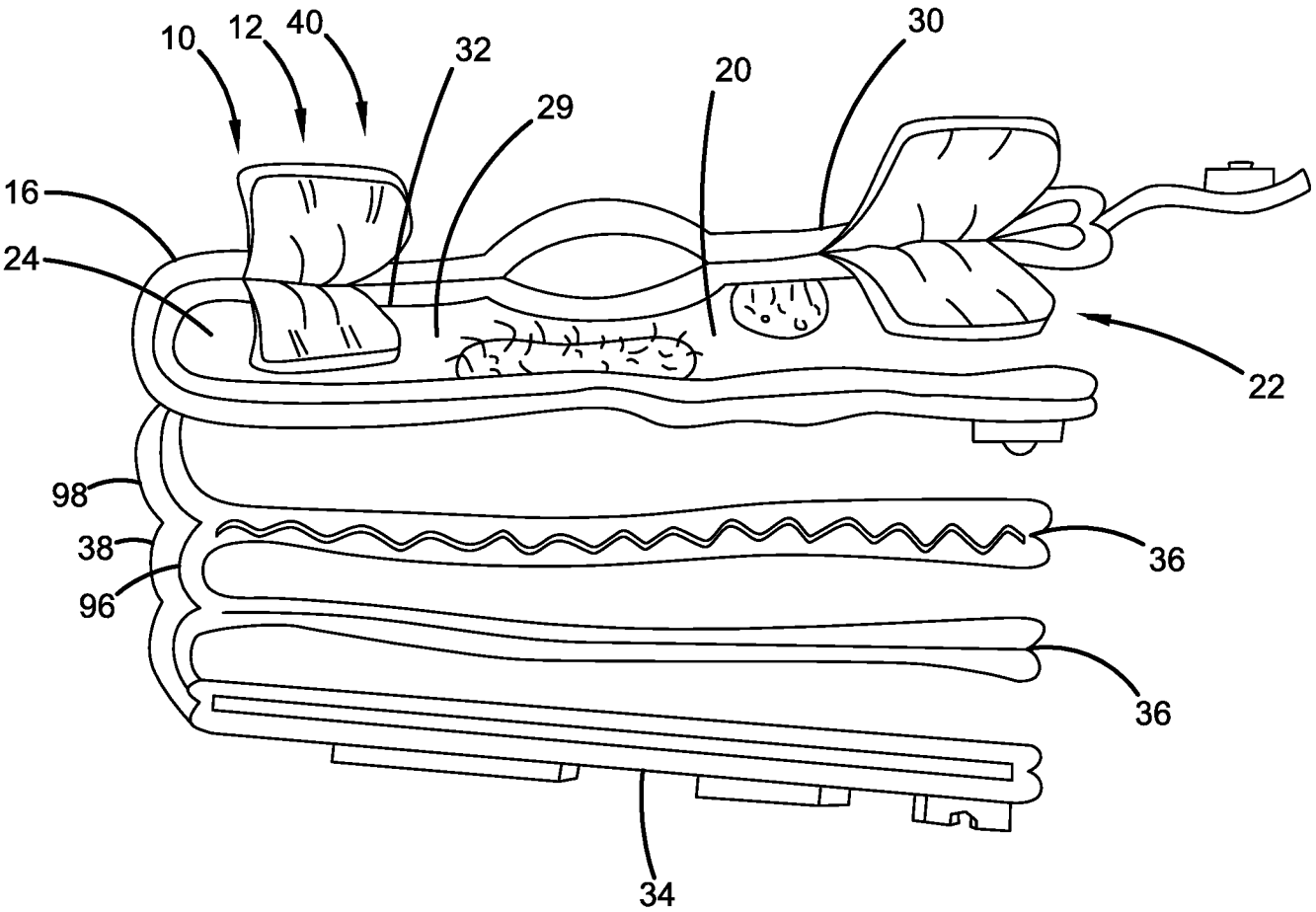
FIG. 8 is a top side cross sectional view of the further alternative exemplary item of FIG. 7 in a book configuration, and in a closed book position.
Figure 9A:
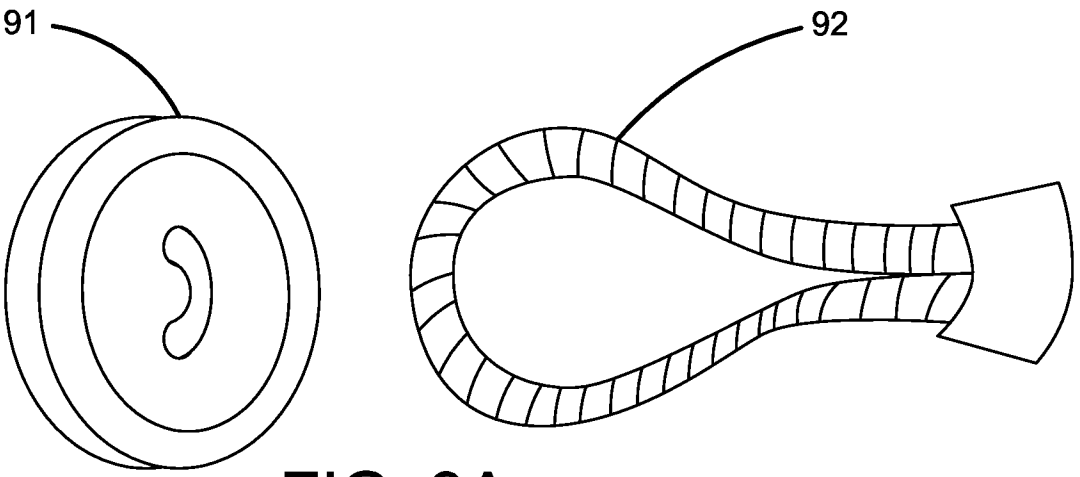
FIG. 9A is an exemplary releasable clasp including an exemplary piece including a button and an exemplary piece including a hole.
Figure 9B:
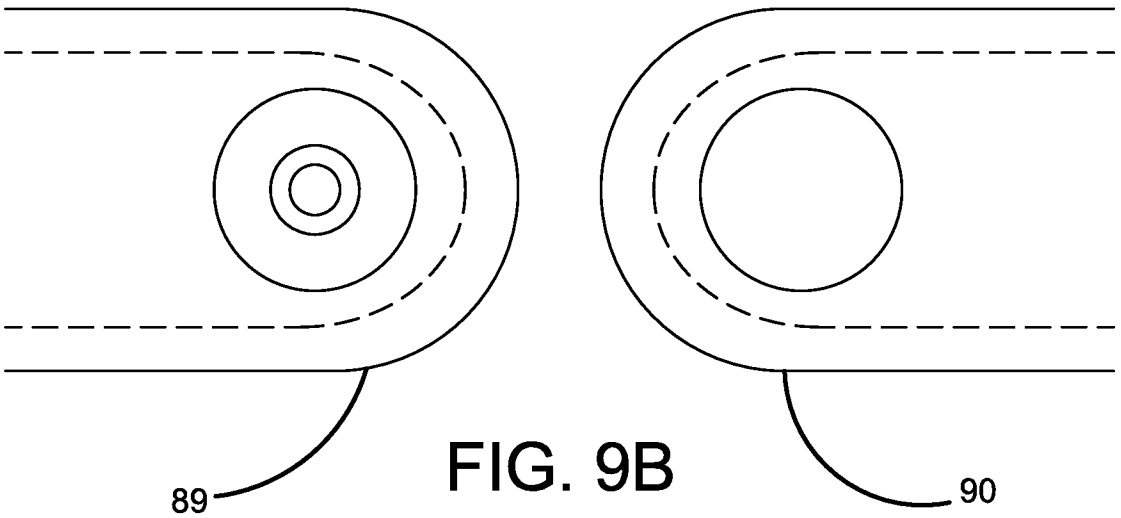
FIG. 9B is an alternative exemplary releasable clasp including an exemplary first snap piece and an exemplary second snap piece.
Figure 10A:
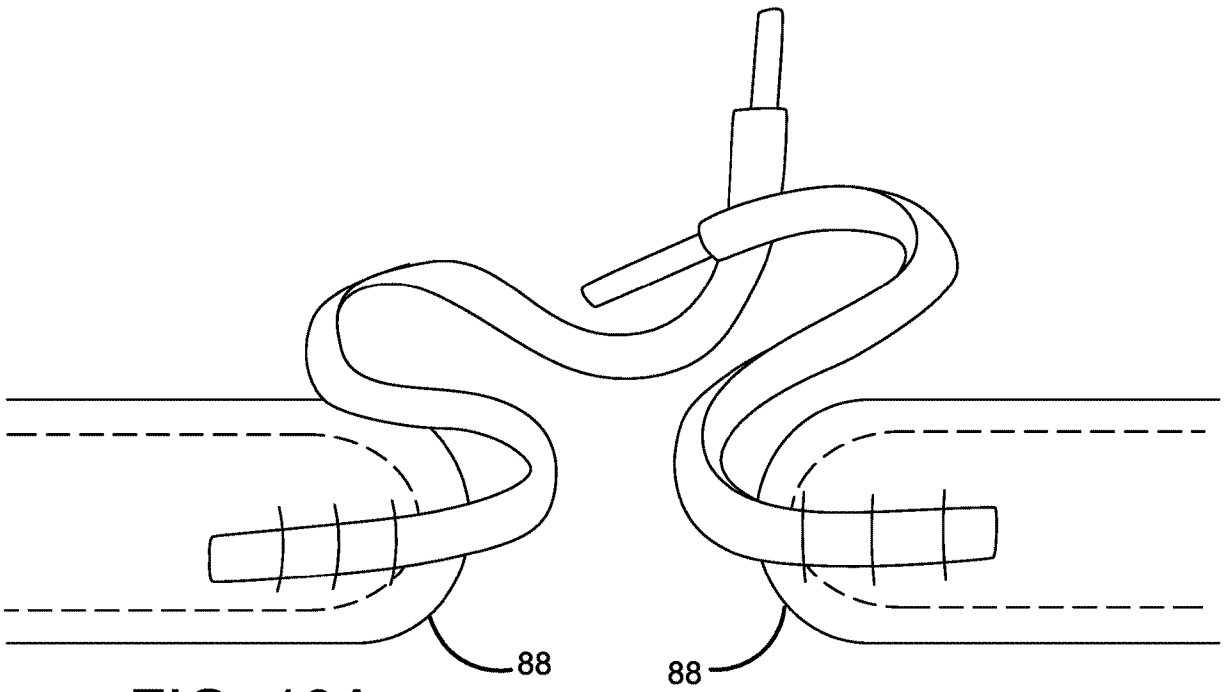
FIG. 10A is a further alternative exemplary releasable clasp including an exemplary pair of tieable laces.
Figure 10B:
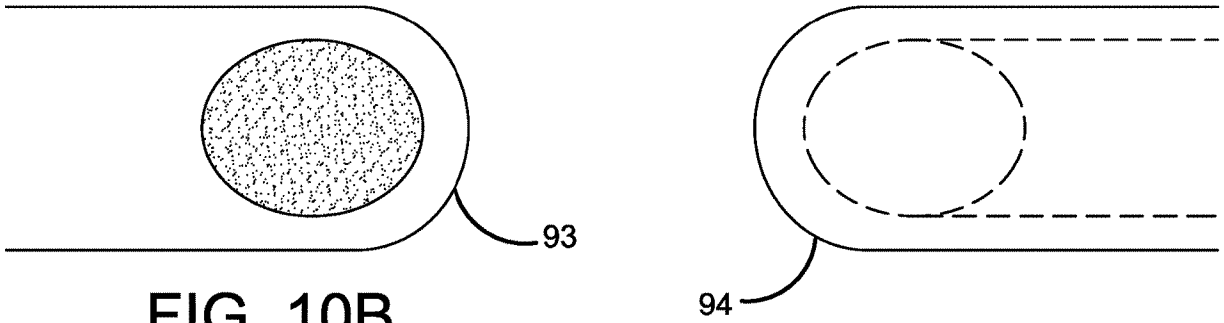
FIG. 10B is a further alternative exemplary releasable clasp including an exemplary hoop structure and an exemplary loop structure.

Referring to the cross-sectional view of FIG. 8, the exemplary item 10 in the book configuration 12 and in the closed book position 40, includes the first cover 16, the second cover 34, and the plurality of pages 36 in sandwiched relation between the first and second covers. First cover 16 includes the cover pocket 20 extending therein. Cover pocket 20 includes the cover pocket open end 22, the cover pocket closed end 24, and the pair of cover pocket closed side edges 26 and 28 as previously discussed. Cover pocket 20 includes the cover pocket interior area 29 bounded by the second side 32 of the flexible material 18. The first side 30 of the material of the first cover 16, second cover 34, and plurality of pages 36 are connected in operatively attached movable engagement with the spine 38. Spine 38 includes the exposed side 98 with the viewable spine indicia 99 thereon. The plurality of pages 36 are in attached connection with the first side 96 of the spine. Of course, the construction shown is exemplary of numerous approaches that may be used.

Figure 12:
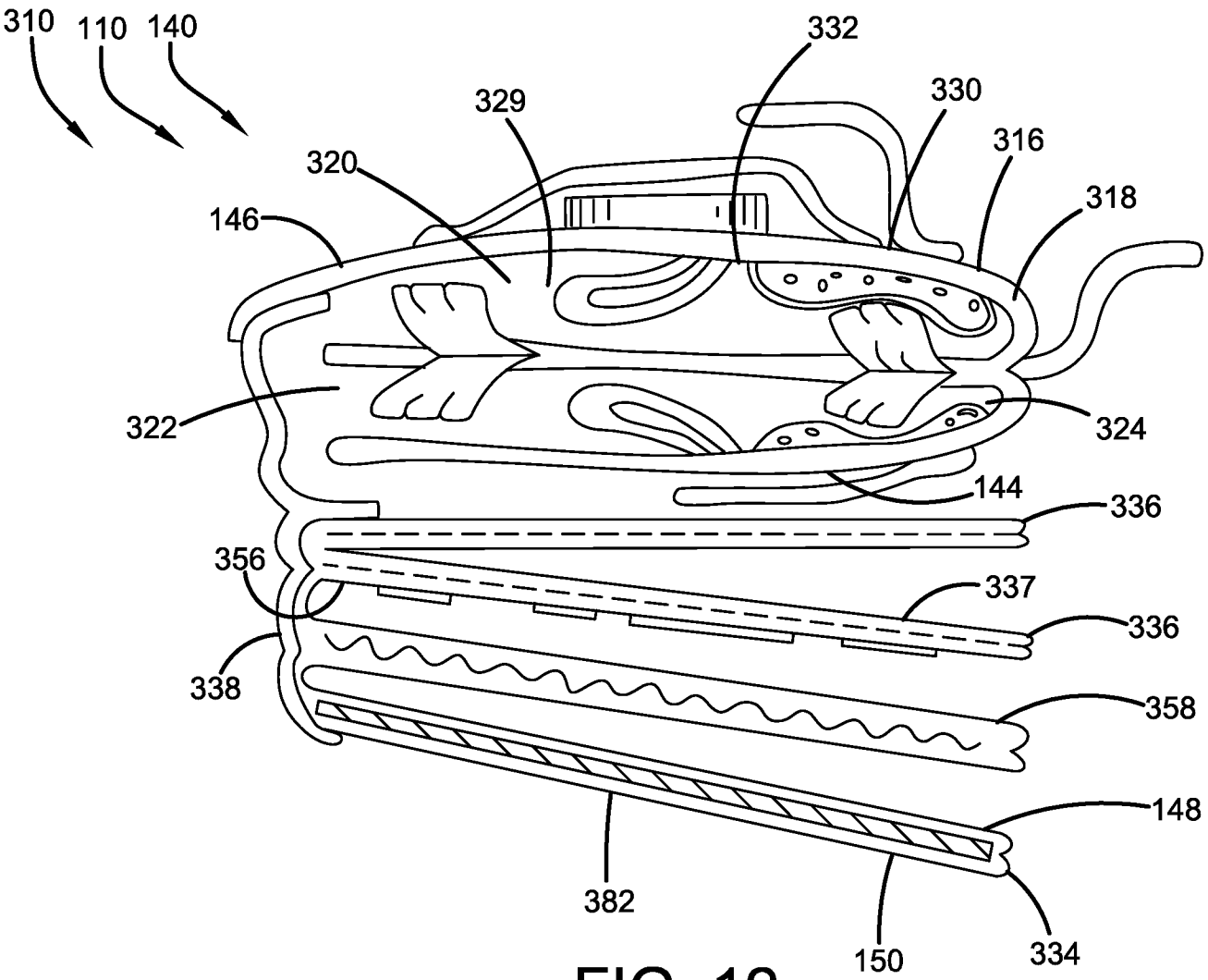
FIG. 12 is a top side cross sectional view of a further alternative exemplary item in a first book configuration and in a closed book position.

An alternative exemplary embodiment, is shown in cross section in FIG. 12. The alternative embodiment 310 is manually transformable between a first book configuration 110, a first toy configuration 112, a second book configuration 114, and a second toy configuration 116. In the exemplary first book configuration 110 the item 310 includes the first cover 316, the second cover 334, the plurality of pages 336, and the spine 338.

Figure 13:
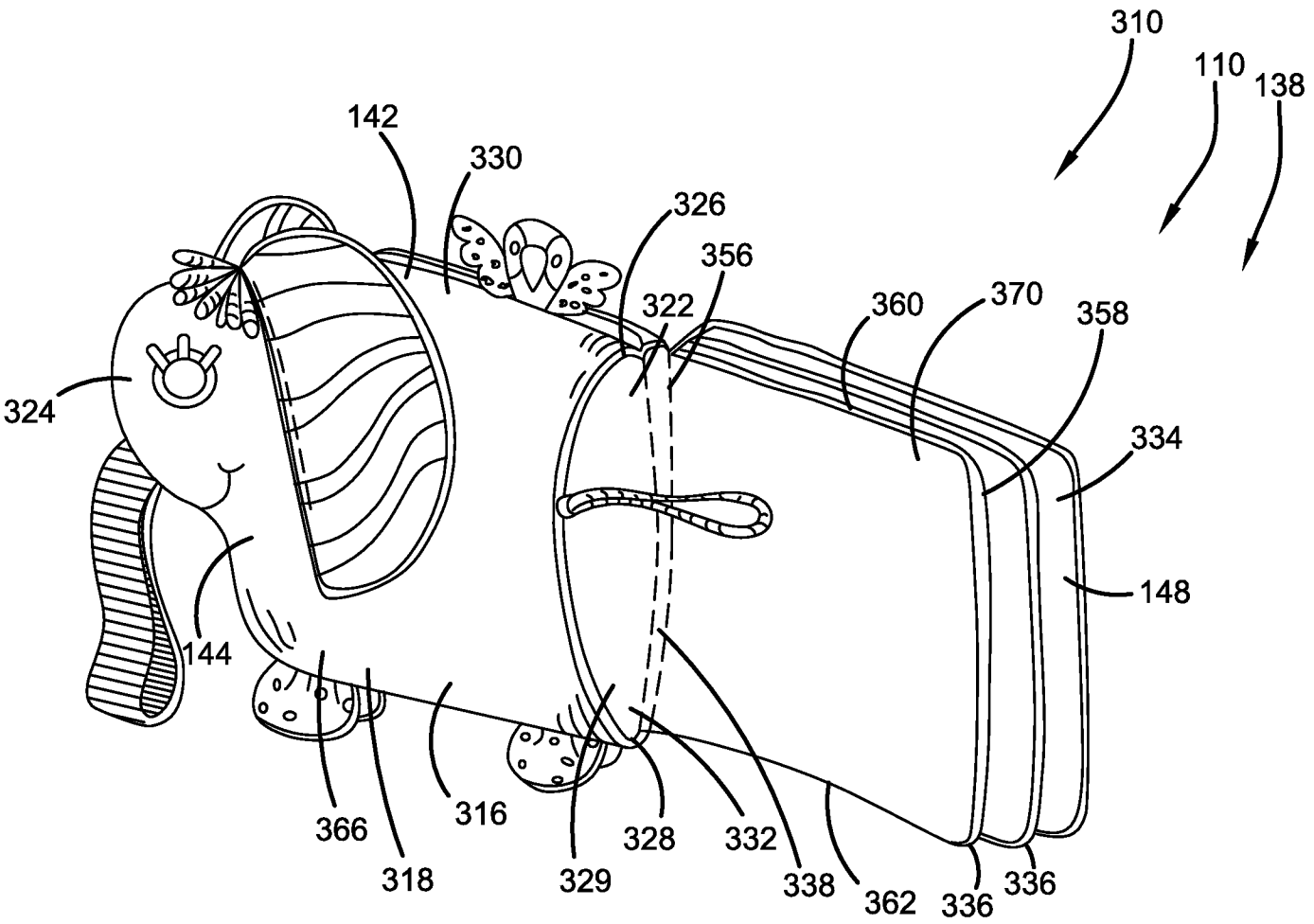
FIG. 13 is a front side perspective view of the exemplary item of FIG. 12 in a first book configuration and in an open book position.

In the exemplary first book configuration 110, as shown in FIGS. 12 and 13, the first cover 316 is comprised of flexible material 318. The first cover 316 includes the cover pocket 320 extending therein. The cover pocket 320 includes the cover pocket open end 322, the opposed cover pocket closed end 324, and the pair of cover pocket closed side edges 326 and 328 shown in phantom in FIG. 12 but more clearly shown in FIG. 13. The cover pocket closed side edges 326 and 328 extend between the open end 322 and the closed end 324. Of course, it should be understood that this configuration is exemplary, and in other embodiments, other configurations may be used.

In the exemplary first book configuration 110, the flexible material 318 includes the first side of the material 330 and the second side of the material 332. The first side 330 of the material is externally exposed on the item 310 in the first book configuration 110. The second side of the material 332 bounds the cover interior area 329 of the cover pocket 320.

Referring again to FIG. 12, in the exemplary first book configuration 110, and in a closed first book position 140, the second cover 334 is disposed away from the first cover 316 and separated by the plurality of pages 336. The exemplary plurality of pages 336 are in sandwiched relation between the first side of the flexible material 318 of the first cover 316 and the second cover 334. In the exemplary first book configuration 110, and in an open first book position 138 the first cover 316 and the second cover 334 are manually movable to be sufficiently disposed away from one another such that each of the opposed faces 337 of each of the plurality of pages 336 are manually positionable to be separately viewable. Of course, it should be understood that this configuration is exemplary, and in other embodiments, other configurations may be used.

In the exemplary first book configuration 110, the first cover 316, the plurality of pages 336, and the second cover 334 are connected to the spine 338 in operatively attached movable engagement. The spine 338 is connected to the flexible material at a first cover outside face 146 of the first cover 316. The spine 338 is connected to the first cover 316 such that the open end 322 of the cover pocket 320 is immediately adjacent the spine 338. A first cover inside face 144 of the first cover 316 is in adjacent abutting relation with a first page immediately adjacent the first cover 316 such that the open end of the cover pocket 320 is immediately adjacent the spine 338 and the first end 356 of the first page. Thus, the closed end 324 of the cover pocket 320 is immediately adjacent the second end 358 of the first page.

The exemplary second cover 334 has a second cover inside face 148 and a second cover outside face 150. The second cover inside face 148 is engageable with a last page immediately adjacent the second cover 334. In the exemplary first book configuration 110, the second cover outside face 150 is externally exposed on the item 310 and includes exposed viewable second cover indicia 382.

Each page of the exemplary plurality of pages 336, as shown in FIG. 13, includes the first end 356, the second end 358, and the pair of disposed page edges 360 and 362 that extend between the first end 356 and the second end 358. In the exemplary first book configuration 110, the first end of each of the plurality of pages 336 is operatively attached to the spine 338 and is immediately adjacent the open end 322 of the cover pocket 320. Each of the opposed faces 337 of each of the plurality of pages comprise planar faces that extend in generally parallel relation. The first end 356, second end 358 and the pair of disposed page edges 360 and 362 of each respective page define a page shape 370. Each of the plurality of pages 336 are generally of the page shape 370. Of course, it should be understood that this embodiment is exemplary, and in other embodiments, other configurations may be used.

Figure 14:
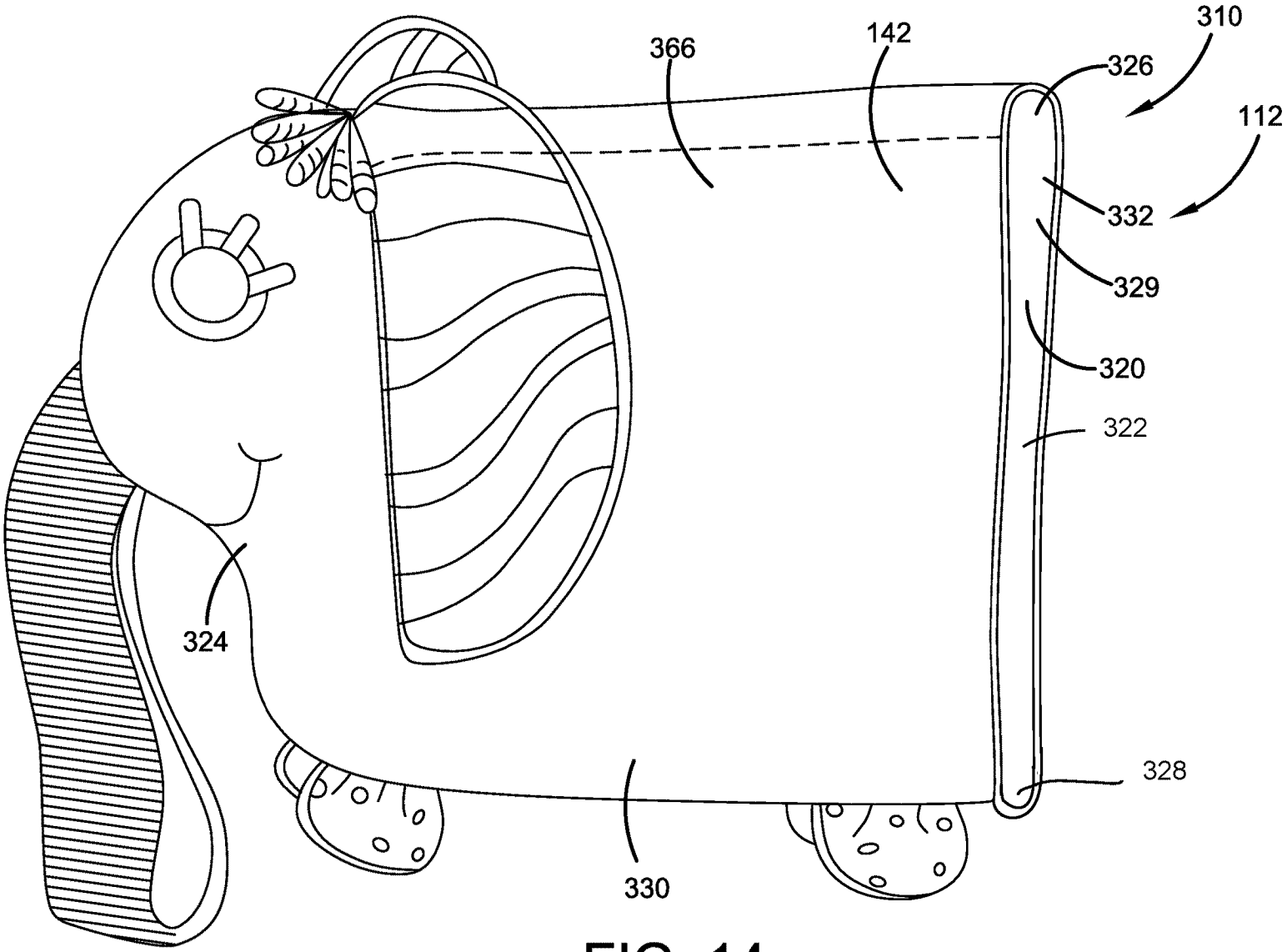
FIG. 14 is a front side view of the item of FIG. 12 in a first toy configuration.

Referring again to FIG. 13, in the exemplary first book configuration 110, and in the open first book position 138, the item 310 is changeable from the first book configuration 110 to the first toy configuration 112 by manual insertion of each of the plurality of pages 336 and the second cover 334 into the cover interior area 329 of the cover pocket 320. In the first toy configuration 112, as shown in FIG. 14, each of the plurality of pages 336 and the second cover 334 are housed within the cover interior area 329 in underlying relation of the second side 332 of the flexible material 318. The exemplary item 310 is returned to the first book configuration 110 by manual removal of the plurality of pages 336 and the second cover 334 from the cover interior area 329 of the cover pocket 320.

In the exemplary first toy configuration 112, as shown in FIG. 14, the first end 356 of each of the plurality of pages 336 and the spine 338 are housed within the cover pocket 320 and are immediately adjacent the open end 322 of the cover pocket 320. The second end 358 of each of the plurality of pages, when the item 310 is in the exemplary first toy configuration 112, is immediately adjacent the closed end 324 of the cover pocket 320. Further, in the exemplary first toy configuration 112, a respective one of the pair of disposed page edges 360 and 362 that extend between the first end 356 and second end 358 is immediately adjacent a respective one of the pair of closed side edges 326 and 328 of the cover pocket 320.

Referring again to FIG. 13, the exemplary flexible material 318 of the first cover 316 may be comprised of elastic material 366. In the exemplary first book configuration 110, the elastic material 366 of the first cover 316 has an undeformed first book configuration cover shape 142. The elastic material 366 of the first cover 316 is stretched when each of the plurality of pages 336 and the second cover 334 are manually inserted into the cover pocket 320. The elastic material 366 returns to the undeformed first book configuration cover shape 142 when returned to the first book configuration 110. In the first book configuration 110, when the plurality of pages 336 and the second cover 334 are manually inserted into the cover pocket 320 to form the first toy configuration 112, the flexible material 318 conforms to the page shape 370 of the plurality of pages. As can be appreciated in some embodiments the page shapes may be contoured to have the item conform to a desired shape when in the toy condition.

Figure 15:
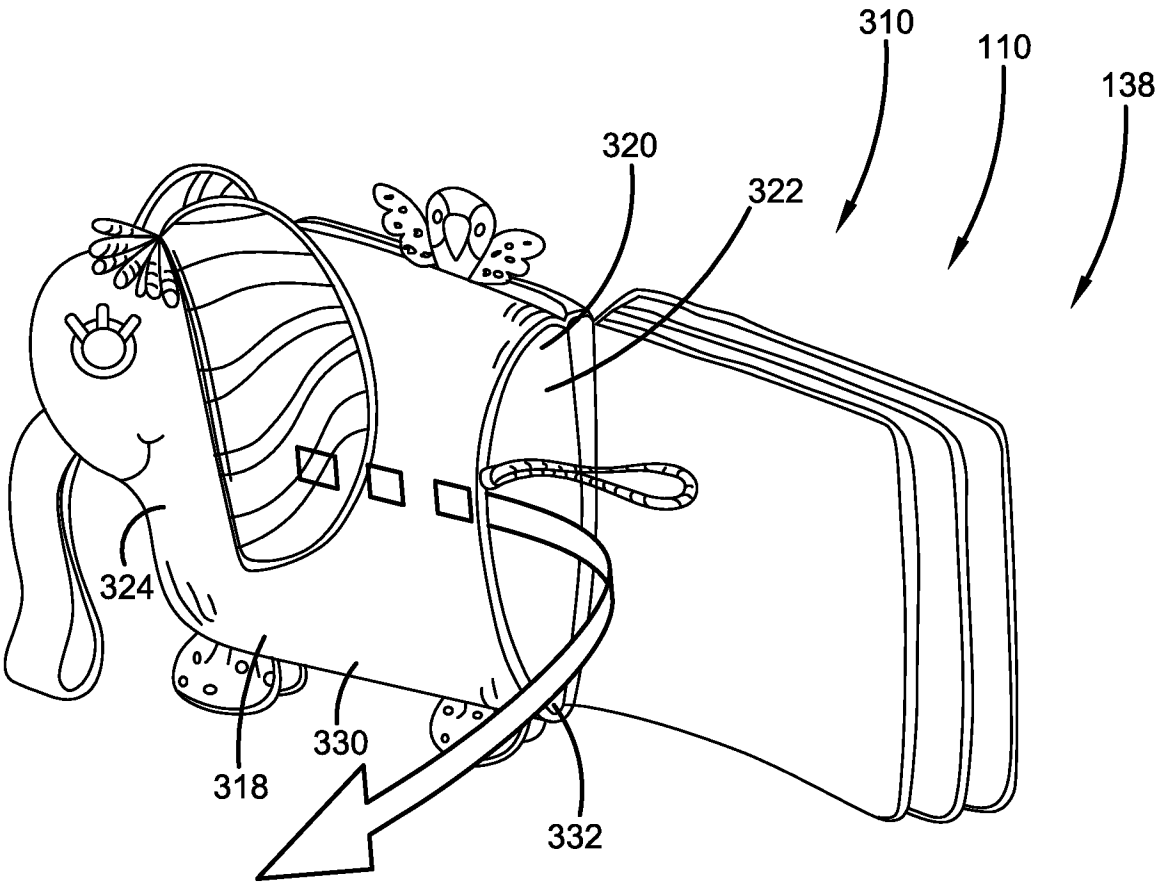
FIG. 15 is a front side perspective view of the item of FIG. 12 in the first book configuration and in an open book position.
Figure 16:
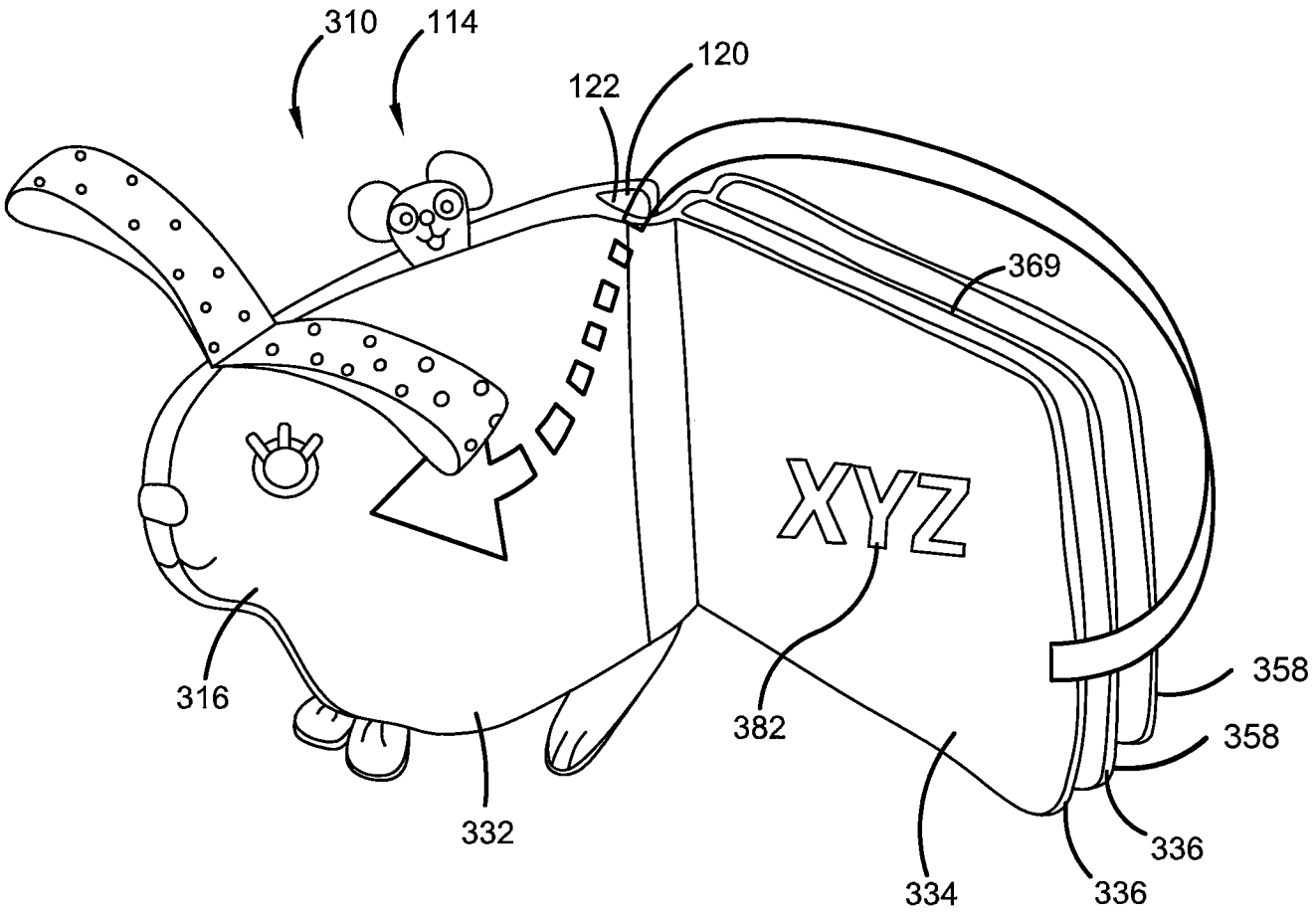
FIG. 16 is a back side perspective view of the exemplary item of FIG. 12 in a second book configuration and in an open book position.

As shown in sequential steps in FIG. 15 and FIG. 16, exemplary item 310 is changeable from the open book position 138 of the first book configuration 110 to the second book configuration 114 by the cover pocket 320 being manually turned inside out as shown by the dotted arrow in FIG. 15 to form a second book configuration pocket 120. As shown in FIG. 16, in the exemplary second book configuration 114 the second side 332 of the flexible material of the first cover 316 is externally exposed on the item 310 and the first side 330 of the flexible material bounds a further interior area 122 of the second book configuration pocket 120.

Figure 17:
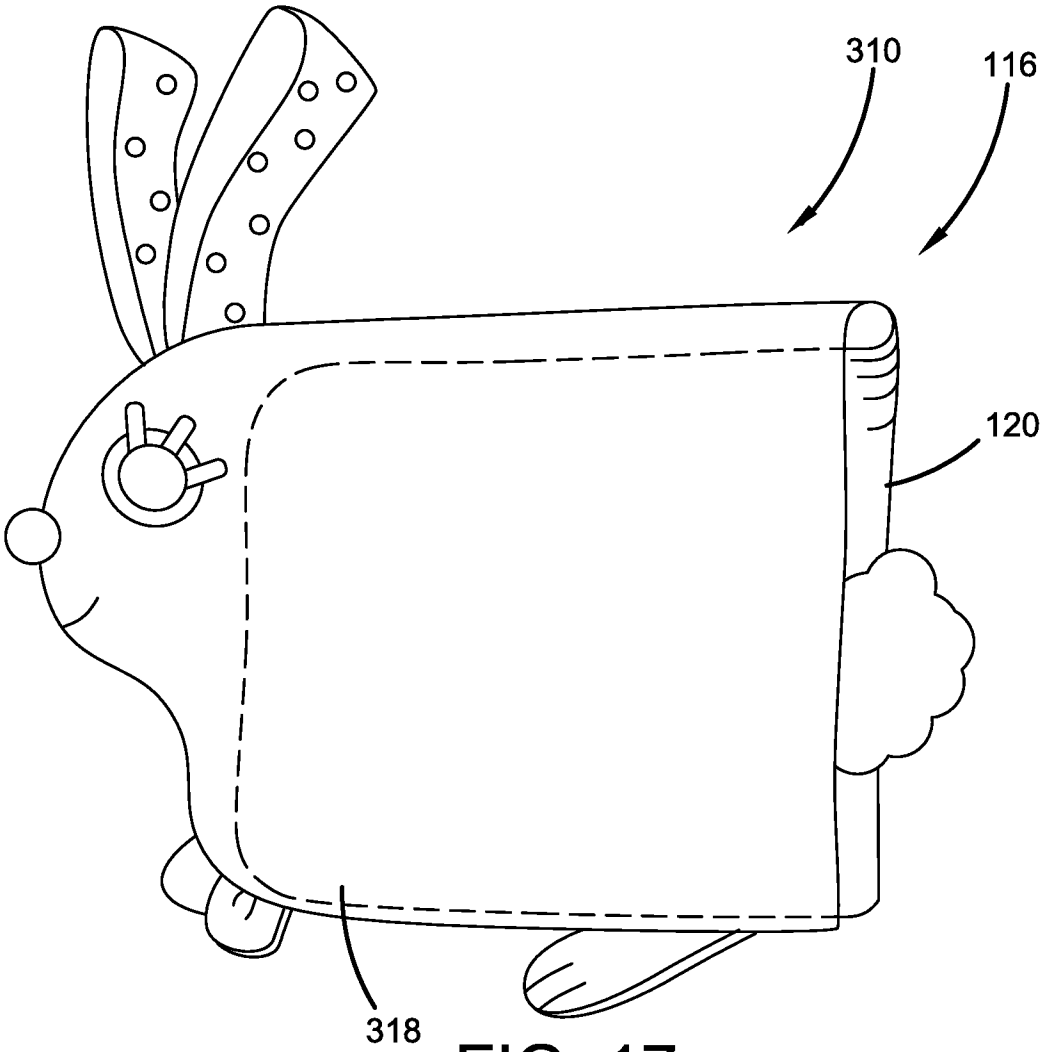
FIG. 17 is a front side view of the exemplary item of FIG. 12 in a second toy configuration.

Exemplary item 310 is changeable from the second book configuration 114 to the second toy configuration 116 by manual insertion of each of the plurality of pages 336 and the second cover 334 into the further interior area 122 of the second book configuration pocket 122. The plurality of pages 336 are manually inserted into the further interior area by bending each of the plurality of pages such that the second end 358 of each page is manually insertable into the second book configuration pocket 120 as represented by the dotted arrow in FIG. 16. In the exemplary second toy configuration 116, as shown in FIG. 17 the plurality of pages 336 and the second cover 334 are housed within the interior area of the second book configuration pocket 120. When the plurality of pages are manually inserted into the second book configuration pocket 120 to form the second toy configuration 116, the flexible material 318 conforms to the page shape 370 of the plurality of pages 336.

In the particular embodiment shown in FIG. 16, each of the exemplary plurality of pages 336 is comprised of a page material 369. The page material 369 of each of the plurality of pages 336 may be more rigid than the flexible material 318 or elastic material 366 of the first cover 316. In addition to being more rigid than the flexible material 318 or elastic material 366, the exemplary page material 369 is simultaneously flexible such that each of the plurality of pages 336 is manually bendable for insertion into the second book configuration pocket 120. The rigid yet flexible page material 369 allows for each of the pages to be bent, folded in half, or folded back on itself in order to manually maneuver the page into the second book configuration pocket 120.

Figure 18:
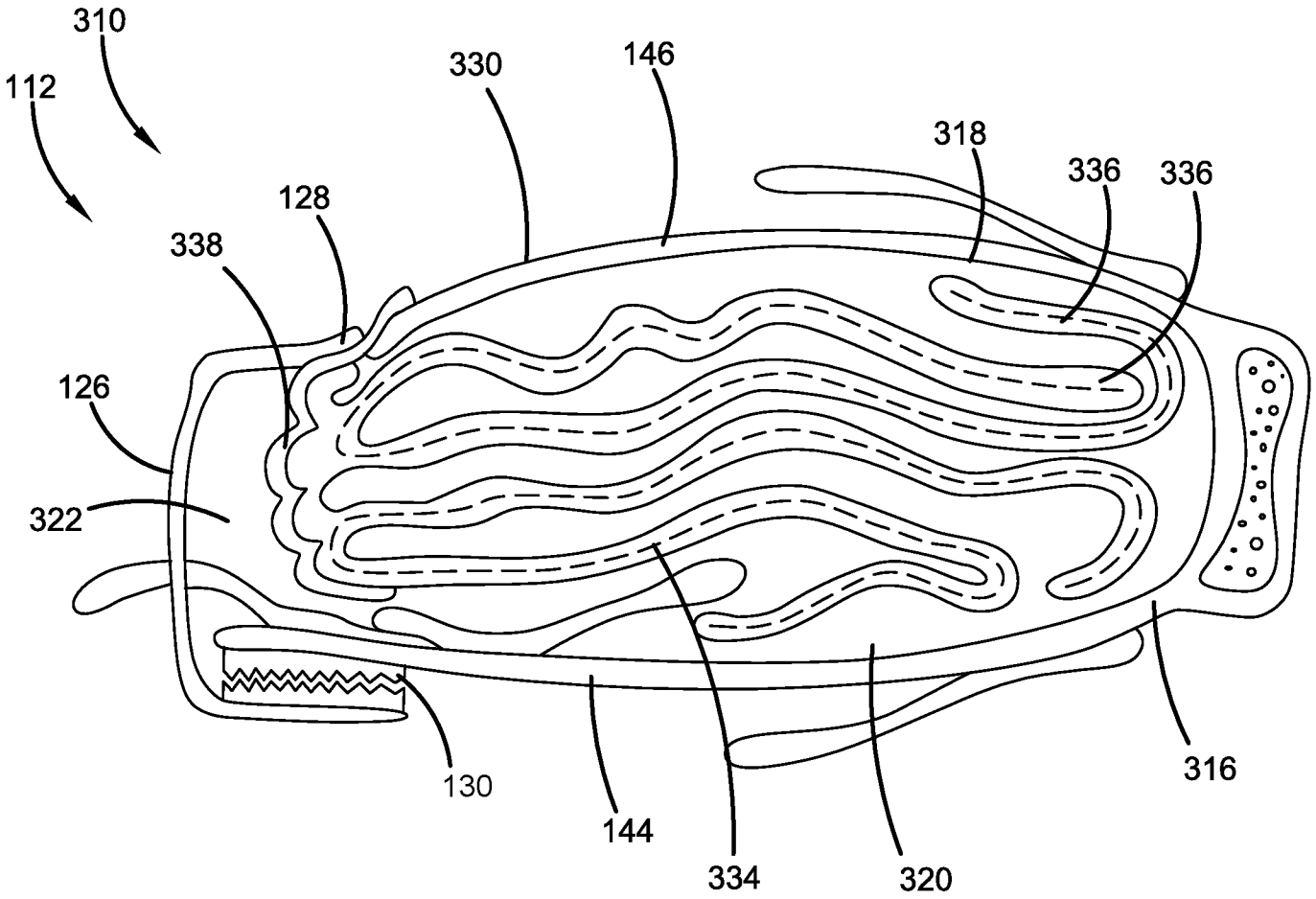
FIG. 18 is a top side cross sectional view of an exemplary item of FIG. 12 in the first toy configuration.

Referring now to FIG. 18, in the first toy configuration 110, the item 310 further includes a releasable first toy clasp 126. The releasable first toy clasp 126 is operatively attached to the first cover 316. The releasable first toy clasp 126 includes a first releasable first toy clasp piece 128 and a second releasable first toy clasp piece 130 that are releasably engageable with one another. The first releasable first toy clasp piece 128 is in operative fixed attachment with the first side 330 of the flexible material 318 of the first cover 316 on the first cover outside face 146 adjacent the open end 322 of the cover pocket 320. The second releasable first toy clasp piece is in operative fixed attachment with the first side of the flexible material 318 of the first cover 316 on the first cover inside face 144 adjacent the open end 322 of the cover pocket 320. The releasable first toy clasp 126 allows the second cover 334, the plurality of pages 336, and the spine 338 to be securely fixed inside the cover pocket 320 when the item 310 is in the first toy configuration 112. Of course, it should be understood that this releasable first toy clasp configuration is exemplary, and in other embodiments, other releasable clasp configurations may be used. For example, item 310 may include first and second releasable clasp pieces operatively attached to the item 310 at different points such that the item 310 may be securely fixed in the first book configuration, second book configuration, or second toy configuration. It should be understood that using the principles described herein a single item may have additional book and toy configurations.

While the exemplary features have been shown and described with references to certain embodiments thereof, it will be understood by those skilled in the art that the foregoing and other modifications or changes in form and details may be made therein without departing from the spirit and scope of the exemplary embodiments as claimed.

It should be mentioned, that while the exemplary embodiments have been described with regard to certain elements, other elements may be used in other embodiments and the functionality achieved by a single element as described herein in connection with an embodiment may be carried out through the combination of multiple elements in other embodiments. Likewise, the functions and embodiments achieved by multiple elements as described herein may be achieved in other arrangements by a single element. Further, while examples have been provided for purposes of explanation, it is to be understood that these are exemplary embodiments and are not to be construed as limiting the hereto appended claims. Additionally, it should be recognized that the examples provided herein may be modified or permutated while still falling within the scope of the claims.

Thus, the exemplary embodiments achieve new and improved functionality, eliminate difficulties encountered in the use of prior devices and arrangements, and attain the useful results described herein.

In the foregoing description, certain terms have been used for brevity, clarity and understanding. However, no unnecessary limitations are to be implied therefrom because such terms are used for descriptive purposes and are intended to be broadly construed. Moreover, the descriptions and illustrations herein are by way of examples and the inventive aspects are not limited solely to the features shown and described.

Further, in the following claims, any feature described as a means for performing a function shall be construed as encompassing any means known to those skilled in the art as being capable of carrying out the recited function, and shall not be deemed limited to the particular means shown or described for performing the recited function in the foregoing description, or mere equivalents thereof.

Having described the features, discoveries, and principles of the exemplary embodiments, the manner in which they are constructed and operated, and the advantages and useful results attained; the new and useful structures, elements, arrangements, parts, combinations, and relationships are set forth in the appended claims.

I claim:

1. Apparatus comprising:

an item that is manually transformable between a book configuration and a toy configuration, wherein in the book configuration the item includes, a first cover, wherein the first cover is comprised of flexible material and includes a cover pocket extending therein, wherein the flexible material includes a first side of the material and a second side of the material, wherein in the book configuration, the first side of the material is externally exposed and the second side of the material bounds a cover interior area of the cover pocket, wherein the second side of the material that bounds the interior area of the cover pocket includes a cover pocket open end, an opposed cover pocket closed end, and a pair of cover pocket closed side edges that extend between the cover pocket open end and the cover pocket closed end, a second cover, a plurality of pages, wherein each page includes a pair of opposed faces, a spine, wherein the spine connects in operatively attached movable engagement the second cover, each of the plurality of pages, and the first cover, wherein the spine is in operative attached connection with the first cover in overlying relation of the cover pocket closed end, wherein in the book configuration the item is manually movable between a closed book position and an open book position, wherein in the closed book position each of the plurality of pages are in sandwiched relation between the first cover and the second cover, and wherein in the open book position the first cover and the second cover are disposed away from one another, whereby each of the opposed faces of each page are manually positionable to be separately viewable, wherein the item is changeable from the book configuration to the toy configuration by the cover pocket being manually turned inside out to form a toy pocket that extends within the first cover, wherein in the toy configuration of the item, the second side of the material is externally exposed on the toy and the first side of the material bounds a toy interior area of the toy pocket, the first side of the material that bounds the toy interior area includes a toy pocket open end, an opposed toy pocket closed end, and a pair of toy pocket closed side edges that extend between the toy pocket open end and the toy pocket closed end, and wherein each of the plurality of pages and the second cover are housed within the toy interior area of the toy pocket in underlying relation of the first side of the material.

2. The apparatus according claim 1 wherein each of the plurality of pages has a first end, a second end, and a pair of disposed page edges that extend between the first and second ends, wherein in the book configuration the first end of each of the plurality of pages is operatively attached to the spine and is immediately adjacent the closed end of the cover pocket, and wherein in the toy configuration the first end of each of the plurality of pages and the spine are housed within the toy pocket and are immediately adjacent the toy pocket closed end such that the second end of each of the plurality of pages is immediately adjacent the toy pocket open end, and a respective one of the pair of disposed page edges that extend between the first and second ends are immediately adjacent a respective one of the pair of toy pocket closed side edges.

3. The apparatus according to claim 2 wherein the flexible material of the first cover is comprised of elastic material, and wherein in the book configuration the flexible material has an undeformed book cover shape, wherein the flexible material of the first cover is stretched when turned inside out to form the toy pocket and returns to the undeformed book cover shape when returned to the book configuration.

4. The apparatus according to claim 3 wherein each of the plurality of pages is comprised of a page material, wherein the page material is more rigid than the elastic material of the first cover.

5. The apparatus according to claim 4 wherein each of the opposed faces of each of the plurality of pages comprise planar faces that extend in generally parallel relation, and wherein the page edges of each respective page define a page shape, wherein each of the plurality of pages is of the page shape, wherein when the flexible material of the first cover is manually turned inside out such that the item is in the toy configuration, the flexible material conforms to the page shape of the plurality of pages.

6. The apparatus according to claim 5 wherein the toy pocket open end includes a toy pocket opening, and wherein the first cover includes an elastic ring that extends in surrounding relation of the toy pocket opening.

7. The apparatus according to claim 6 wherein the pair of disposed page edges of each page are disposed a second end page dimension from each other at the second end of each page, wherein in the toy configuration, the toy pocket opening is smaller than the second end page dimension.

8. The apparatus according to claim 7 wherein the item further includes a releasable clasp, wherein in the book configuration of the item the releasable clasp is operatively attached to the first cover and the second cover and includes:

a first piece and a second piece, wherein the first piece and the second piece are releasably engageable, and wherein the first piece is in operative fixed attachment with the first cover and the second piece is in operative fixed attachment with the second cover.

9. The apparatus according to claim 8 wherein the first piece and the second piece of the releasable clasp comprise at least one of a pair of hook and loop structures, a pair of tieable laces, a button piece including a button and a hole piece including a hole, or a releasably engageable first snap piece and a second snap piece.

10. The apparatus according to claim 9 wherein each of the plurality of pages are comprised of plush material, and wherein the spine is comprised of flexible material.

11. The apparatus according to claim 1 wherein the flexible material of the first cover is comprised of elastic material, wherein each of the plurality of pages is comprised of a page material, wherein the page material is more rigid than the elastic material, wherein each of the plurality of pages extend in generally parallel relation, wherein each of the plurality of pages is bounded by respective page edges and the page edges of each respective page of the plurality of pages define a page shape, wherein each of the pages is of the page shape, wherein when the flexible material of the first cover is manually turned inside out so as to surround the plurality of pages such that the item is in the toy configuration, the flexible material conforms to the page shape of the plurality of pages.

12. The apparatus according to claim 1 wherein the toy pocket open end includes a toy pocket opening, and wherein the first cover includes an elastic ring that extends in surrounding relation of the toy pocket opening.

13. The apparatus according to claim 1 wherein the cover is comprised of an elastic stretchable material, and wherein at least one page is comprised of a more rigid material than the cover material, wherein the at least one page has a non-rectangular contoured shape, wherein in the toy configuration the cover conforms to the contoured shape.

14. Apparatus comprising:

an item that is manually transformable between a book configuration and a toy configuration, wherein in the book configuration the item includes, a cover, wherein the cover is comprised of flexible material, wherein the cover includes a cover pocket extending therein, wherein the cover pocket has a cover pocket open end, an opposed cover pocket closed end and a pair of cover pocket closed side edges that extend between the cover pocket open end and the cover pocket closed end, wherein in the book configuration, a first side of the material is externally exposed and a second side of the material bounds an interior area of the cover pocket, a plurality of pages, wherein each page includes a pair of opposed faces, wherein each page includes an attachment edge, wherein each of the plurality of pages are connected in operatively attached movable engagement with each of the other plurality of pages along the attachment edge of each respective page, wherein each of the plurality of pages is connected in operatively attached movable engagement with the first cover at the attachment edge of each respective page in overlying relation of the closed end of the cover pocket, wherein in the book configuration the item is movable between an open book position and a closed book position, wherein in the open book position each of the plurality of pages are manually movable to be sufficiently disposed away from one another, whereby each of the opposed faces of each of the plurality of pages are manually positionable to be separately viewable, and wherein in the closed book position each of the plurality of pages and the first cover are in adjacent abutting relation, wherein the item is changeable from the book configuration to the toy configuration by the cover pocket being manually turned inside out to form a toy pocket, wherein in the toy configuration, the second side of the material is externally exposed on the toy and the first side of the material bounds a toy interior area of the toy pocket, the first side of the material bounds the toy interior area and includes a toy pocket open end, an opposed toy pocket closed end, and a pair of toy pocket closed side edges that extend between the toy pocket open end and the toy pocket closed end, and wherein each of the plurality of pages and their respective attachment edge are housed within the toy interior area of the toy pocket in underlying relation of the first side of the material.

15. The apparatus according to claim 14 wherein each of the plurality of pages has a first end, a second end, and a pair of disposed page edges that extend between the first and second ends, wherein in the book configuration the first end of each of the plurality of pages is bounded by the attachment edge of each respective page and is immediately adjacent the closed end of the cover pocket, and wherein in the toy configuration the first end of each of the plurality of pages are housed within the toy pocket and are immediately adjacent a toy pocket closed end such that the second end of each of the plurality of pages is immediately adjacent a toy pocket open end, and the pair of disposed page edges that extend between the first and second ends are immediately adjacent a respective one of the pair of closed side edges of the toy pocket.

16. The apparatus according to claim 15 wherein the flexible material of the cover is manually turnable inside out in a telescoping manner to change the item from the book configuration to the toy configuration, such that in the toy configuration the flexible material surrounds each of the plurality of pages between the first end and the second end.

17. The apparatus according to claim 16 wherein the cover is comprised of elastic material and in the book configuration has an undeformed book cover shape, wherein the flexible material of the cover is stretched when turned inside out to form the toy pocket and returns to the undeformed book cover shape when returned to the book configuration.

18. The apparatus according to claim 17 and further comprising:

a releasable clasp, wherein the releasable clasp is operatively attached to the cover and the last page and includes:

a first piece and a second piece wherein the first piece and the second piece are releasably engageable, wherein the first piece is in operative fixed attachment with the cover and the second piece is in operative fixed attachment with the page disposed furthest away from the cover in the closed book position.

19. The apparatus according to claim 14 wherein the flexible material of the cover is comprised of elastic material, wherein each of the plurality of pages is comprised of a page material, wherein the page material is more rigid than the elastic material, wherein in the closed book position each of the plurality of pages extends in generally parallel relation, wherein the page edges of each of the plurality of pages define a page shape, wherein each of the plurality of pages is of the page shape, wherein when the flexible material of the cover is manually turned inside out so as to surround the plurality pages such that the item is in the toy configuration, the flexible material conforms to the page shape of the plurality of pages.

20. The apparatus according to claim 14 wherein the toy pocket open end includes a toy pocket opening, and wherein the cover includes an elastic ring that extends in surrounding relation of the pocket opening.

21. Apparatus comprising:

an item that is manually transformable between at least one book configuration, and at least one configuration, wherein in a first book configuration the item includes, a first cover, wherein the first cover is comprised of flexible material, wherein the first cover includes a cover pocket extending therein, wherein the cover pocket has a cover pocket open end, an opposed cover pocket closed end, and a pair of closed side edges that extend between the cover pocket open end and the cover pocket closed end, wherein in the first book configuration, a first side of the material is externally exposed and a second side of the material bounds a cover interior area of the cover pocket, a second cover, a plurality of pages, wherein each page includes a pair of opposed faces, a spine, wherein the spine connects in operatively attached movable engagement the second cover, each of the plurality of pages, and the first cover, wherein the spine is connected in operatively attached movable engagement with the first cover such that the cover pocket open end is immediately adjacent the spine, wherein in the first book configuration the item is movable between a closed first book position and an open first book position, wherein in the closed first book position, each of the plurality of pages are in sandwiched relation between the first cover and the second cover, and wherein in the open first book position, the first cover and the second cover are manually movable to be sufficiently disposed away from one another such that each of the opposed faces of each of the plurality of pages is manually positionable to be separately viewable, wherein the item is changeable from the first book configuration to a first toy configuration by manual insertion of each of the plurality of pages and the second cover into the cover interior area of the cover pocket, wherein in the first toy configuration each of the plurality of pages and the second cover are housed within the cover interior area in underlying relation of the second side of the flexible material.

22. The apparatus according to claim 21 wherein the item is changeable from the first book configuration to a second book configuration by the cover pocket being manually turned inside out to form a second book configuration pocket, wherein in the second book configuration, the second side of the material of the first cover is externally exposed and the first side of the material bounds a further interior area of the second book configuration pocket, and wherein the item is changeable from the second book configuration to a second toy configuration by manual insertion of each of the plurality of pages and the second cover into the further interior area of the second book configuration pocket, wherein in the second toy configuration, the plurality of pages and the second cover are housed within the further interior area of the second book configuration pocket in underlying relation of the first side of the material.

23. The apparatus according to claim 22 wherein the flexible material of the first cover is comprised of elastic material and in the first book configuration has an undeformed first book configuration cover shape, wherein the flexible material of the first cover is stretched when each of the plurality of pages and the second cover are manually inserted into the cover pocket and the flexible material returns to the undeformed first book configuration cover shape when returned to the first book configuration.

24. The apparatus according to claim 23 wherein each of the plurality of pages is comprised of a page material, wherein the page material is more rigid than the elastic material of the first cover and is simultaneously flexible such that each of the plurality of pages is manually bendable for insertion into the second book configuration pocket when the item is changed from the second book configuration to the second toy configuration.

25. The apparatus according to claim 24 wherein each of the plurality of pages has a first end, a second end, and a pair of disposed page edges that extend between the first and second ends, wherein in the first book configuration the first end of each of the plurality of pages is operatively attached to the spine and is immediately adjacent the cover pocket open end, wherein in the first toy configuration the first end of each of the plurality of pages and the spine are housed within the cover pocket and are immediately adjacent the cover pocket open end such that the second end of each of the plurality of pages is immediately adjacent the cover pocket closed end, and a respective one of the pair of disposed page edges that extend between the first end and the second end are immediately adjacent a respective one of the pair of cover pocket closed side edges.

26. The apparatus according to claim 25 wherein each of the opposed faces of each of the plurality of pages comprise planar faces that extend in generally parallel relation, and wherein the first and second ends and the pair of disposed page edges of each of the plurality of pages define a page shape, wherein each of the plurality of pages is of the page shape, wherein in the first book configuration, when the plurality of pages and the second cover are manually inserted into the cover pocket to form the first toy configuration, the flexible material conforms to the page shape of the plurality of pages, and wherein in the second book configuration, when the plurality of pages and the second cover are manually inserted into the second book configuration pocket to form the second toy configuration, the flexible material conforms to the page shape of the plurality of pages.

27. The apparatus according to claim 26 wherein in the first book configuration the first cover has a first cover inside face and a first cover outside face, wherein the spine is operatively connected to the first cover outside face, wherein the first cover inside face is in adjacent abutting relation with a first page immediately adjacent the first cover, and wherein the cover pocket open end is immediately adjacent the spine and is in adjacent abutting relation with the first end of the first page, and the cover pocket closed end is in adjacent abutting relation with the second end of the first page.

28. The apparatus according to claim 27 wherein in the first toy configuration the item further includes a releasable first toy clasp, wherein the releasable first toy clasp is operatively attached to the first cover and includes:

a first releasable first toy clasp piece and a second releasable first toy clasp piece wherein the first releasable first toy clasp piece and the second releasable first toy clasp piece are releasably engageable, and wherein the first releasable first toy clasp piece is in operative fixed attachment with the first cover on the first cover outside face adjacent the cover pocket open end and the second releasable first toy clasp piece is in operative fixed attachment with the first cover inside face adjacent the cover pocket open end.

29. Apparatus comprising:

an item that is manually transformable between a book configuration and a toy configuration, wherein in the book configuration the item includes a first cover, wherein the first cover is comprised of flexible material and includes a cover pocket extending therein, wherein the flexible material includes a first side of the material and a second side of the material, wherein in the book configuration, the first side of the material is externally exposed and the second side of the material bounds a cover interior area of the cover pocket, wherein the second side of the material that bounds the interior area of the cover pocket includes a cover pocket open end, an opposed cover pocket closed end, and a pair of cover pocket closed side edges that extend between the cover pocket open end and the cover pocket closed end, a second cover, a plurality of pages, wherein each page includes a pair of opposed faces, a first end, a second end, and a pair of disposed page edges that extend between the first and second ends, a spine, wherein the spine connects in operatively attached movable engagement the second cover, each of the plurality of pages, and the first cover, wherein the spine is in operative attached connection with the first cover in overlying relation of the cover pocket closed end, wherein in the book configuration the first end of each of the plurality of pages is operatively attached to the spine and is immediately adjacent the closed end of the cover pocket, the item is manually movable between a closed book position and an open book position, wherein in the closed book position each of the plurality of pages are is in sandwiched relation between the first cover and the second cover, wherein in the open book position the first cover and the second cover are disposed away from one another, whereby each of the opposed faces of each page are manually positionable to be separately viewable, wherein the item is changeable from the book configuration to the toy configuration by the cover pocket being manually turned inside out to form a toy pocket that extends within the first cover, wherein in the toy configuration of the item, the second side of the material is externally exposed on the toy and the first side of the material bounds a toy interior area of the toy pocket, the first side of the material that bounds the toy interior area includes a toy pocket open end, an opposed toy pocket closed end, and a pair of toy pocket closed side edges that extend between the toy pocket open end and the toy pocket closed end, and each of the plurality of pages, the spine, and the second cover are housed within the toy interior area of the toy pocket in underlying relation of the first side of the material such that the spine is immediately adjacent the toy pocket closed end, the second end of each of the plurality of pages is immediately adjacent the toy pocket open end, and a respective one of the pair of disposed page edges that extend between the first and second ends are immediately adjacent a respective one of the pair of toy pocket closed side edges.

* * * * *